US006083289A

United States Patent [19]

Ono et al.

[11] Patent Number: 6,083,289

[45] Date of Patent: Jul. 4, 2000

[54] PULVERIZED COAL CARRIABILITY IMPROVER

[75] Inventors: Reiji Ono; Takashi Nakaya; Yoshio Kimura; Tsunao Kamijo, all of Hyogo; Kenichi Miyamoto, Wakayama; Takashi Matoba, Wakayama; Hidemi Ohashi, Wakayama; Takehiko Ichimoto, Wakayama, all of Japan

[73] Assignee: Kao Corporation, Tokyo, Japan

[21] Appl. No.: 09/155,296

[22] PCT Filed: Mar. 5, 1997

[86] PCT No.: PCT/JP97/00668

§ 371 Date: Sep. 25, 1998

§ 102(e) Date: Sep. 25, 1998

[87] PCT Pub. No.: WO97/36009

PCT Pub. Date: Oct. 2, 1997

[30] Foreign Application Priority Data

Mar. 25, 1996 [JP] Japan ..... 8-068513

[51] Int. Cl.[7] ..... C10L 9/10; C21B 5/00

[52] U.S. Cl. ..... 44/620; 44/628; 44/641

[58] Field of Search ..... 44/600, 602, 620, 44/628, 641

[56] References Cited

U.S. PATENT DOCUMENTS

| | | | |
|---|---|---|---|
| 1,555,590 | 9/1925 | Lahart | 44/620 |
| 1,958,691 | 5/1934 | Belknap | 44/602 |
| 2,138,825 | 12/1938 | Allen | 44/602 |
| 2,139,398 | 12/1938 | Allen | 44/620 |
| 2,369,024 | 2/1945 | Crecelius | 44/641 |
| 3,961,914 | 6/1976 | Kindig et al. | 44/620 |
| 4,192,652 | 3/1980 | Smith | 44/620 |
| 4,508,573 | 4/1985 | Harris . | |
| 4,605,568 | 8/1986 | Kober . | |
| 4,659,557 | 4/1987 | Lenz et al. . | |
| 5,350,596 | 9/1994 | Walker, Jr. | 44/602 |

FOREIGN PATENT DOCUMENTS

| | | |
|---|---|---|
| 58-132343 | 9/1983 | Japan . |
| 63-224744 | 9/1988 | Japan . |
| 4-268004 | 9/1992 | Japan . |
| 5-78675 | 3/1993 | Japan . |

OTHER PUBLICATIONS

Derwent EPI Patent Abstract of JP 5009518, Jan. 19, 1993.
Derwent WPI Patent Abstract of JP 5025516, Feb. 2, 1993.
Derwebt EPI Patent Abstract of JP 5222415, Aug. 31, 1993.
Derwent WPI Patent Abstract of JP 4224610, Aug. 13, 1992.
Derwent WPI Patent Abstract of JP 5214417, Aug. 24, 1993.
Patent Abstracts of Japan, Koguchi Makoto, "Sorting Device of Powder", JP 59049858 (Mar. 22, 1984) (Abstract).
Database WPI, XP–002099589 (Abstract), Feb. 15, 1985.

*Primary Examiner*—Jacqueline V. Howard
*Attorney, Agent, or Firm*—Birch, Stewart, Kolasch & Birch, LLP

[57] ABSTRACT

The use of pulverized coal as the fuel to be injected into metallurgical or combustion furnace becomes possible enabled by improving the transportability thereof. Further, a pulverized coal is provided, which is inhibiting from bridging or channeling in a hopper, or piping choking. A water-soluble inorganic salt having a polar group is made to adhere to pulverized coal which is prepared from raw coal having an average HGI of 30 or above and which is in a dry state at the injection port of a metallurgical or combustion furnace, The inorganic salt is selected from among $BaCl_2$, $CaCl_2$, $Ca(NO_2)_2$, $Ca(NO_3)_2$, $Ca(ClO)_2$, $K_2CO_3$, KCl, $MgCl_2$, $MgSO_4$, $NH_4BF_4$, $NH_4Cl$, $(NH_4)_2SO_4$, $Na_2CO_3$, NaCl, $NaClO_3$, $NaNO_2$, $NaNO_3$, NaOH, $Na_2S_2O_3$, $Na_2S_2O_5$, $HNO_3$, $H_2SO_4$, $H_2CO_3$, and HCl.

22 Claims, 6 Drawing Sheets

PULVERIZED COAL CARRIABILITY IMPROVER

This application is the national phase under 35 U.S.C. §371 of prior PCT International Application No. PCT/JP97/00668 which has an International filing date of Mar. 5, 1997 which designated the United States of America, the entire contents of which are hereby incorporated by reference.

1. Industrial Field of Application

The present invention relates to a transportability improver for pulverized coal which can improve the transportability of pulverized coal to enable the stable injection of pulverized coal into a metallurgical or combustion furnace at an enhanced feed rate, and a process for operating a metallurgical or combustion furnace by the use of the improver.

2. Prior Art

In the operation of a metallurgical furnace such as a blast furnace, it has been a general practice to charge coke and iron ore into the furnace from the top alternately. However, another operation process has recently been employed frequently, wherein pulverized coal which is inexpensive and excellent in combustibility and exhibits a high calorific value is injected into a blast furnace through an injection port together with hot air to substitute for part of the coke to be charged from the top. This process permits a decrease in the fuel cost, thus being superior to the all-coke operation in this respect.

Further, coal has been reconsidered also as a fuel for combustion furnaces (such as a boiler) substituting for fuel oil. In a combustion furnace, coal is used in the form of CWM (coal/water mixture), COM (coal/oil mixture), pulverized coal or the like. In particular, pulverized coal firing furnaces attract considerable attention, because they can dispense with the use of other media such as water or oil. However, such furnaces as well as blast furnaces have problems resulting from the use of pulverized coal.

Pulverized coal injection is conducted through the steps of preparation of pulverized coal from raw coal by dry pulverization, classification of the obtained pulverized coal, storage of the resulting pulverized coal in a hopper and discharge thereof from the hopper, pneumatic transportation thereof through piping, injection thereof into a metallurgical or combustion furnace through an injection port, and combustion thereof in the furnace, among which the discharge of pulverized coal from a hopper and the pneumatic transportation thereof through piping are accompanied with the problems which will now be described.

That is, the fluidity and other basic physical properties of pulverized coal have significant influence on the discharge and transportation characteristics thereof, while the physical properties vary depending on the kind, particle size and water content thereof. Accordingly, it is difficult to continue the stable injection of pulverized coal having basic physical properties of pulverized coal deviating from the optimum ranges for a long period, because such pulverized coal causes bridging or channelling in a hopper or piping choking in pneumatic transportation.

In order to solve these problems, there have been made attempts to improve the transportability of pulverized coal and various methods therefor have been proposed. Examples of such methods include a method of adding 5 to 20% of char to pulverized coal (JP-A 4-268004), methods of controlling the inert content of coal (the total content of micrinite, ⅓ semifusinite, fusinite and minerals as stipulated in JIS M8816-1979) prior to pulverization (JP-A 5-9518, JP-A 5-25516 and JP-A 5-222415), a method of enhancing the fluidity index of pulverized coal to at least the nominal value of the blast furnace to be used by limiting the kind of the coal (JP-A 4-224610), a method of controlling the coefficient of friction between pulverized coal and piping (JP-A 5-214417), a method of regulating the water content of pulverized coal to a proper level (JP-A 5-78675) and soon. Further, a method of improving the efficiency of pulverization of coal by making a dispersant adhere to the coal has also been proposed in JP-A 63-224744, but this patent document is silent on the transportability of pulverized coal.

However, the above methods have problems that the kind of coal usable for pulverized coal injection is restricted, that the bridging or channelling in a hopper or piping choking cannot be inhibited satisfactorily, that the control device or equipment is costly, and so on. Thus, no practically satisfactory method has been provided as yet.

Meanwhile, the quantity of pulverized coal injected through an injection port in the current operation of a blast furnace is about 50 to 250 kg/t of pig iron. From the standpoint of cost, it is desirable that the quantity thereof is further increased. However, the above methods cannot always attain satisfactory transportability of pulverized coal, thus failing in sharply enhancing the quantity of pulverized coal injected.

DISCLOSURE OF INVENTION

Under these circumstances, the present invention aims at solving the problems of the methods according to the prior art, i.e., at improving the transportability of pulverized coal without any restriction on the kind of coal to inhibit piping choking and bridging in a hopper, thus permitting the stable injection of pulverized coal at an enhanced feed rate.

The inventors of the present invention have made intensive studies for the purpose of attaining the above aim and have found that the transportability of pulverized coal prepared from raw coal having an average HGI of 30 or above can be improved remarkably by making a water-soluble inorganic salt adhere thereto. The present invention has been accomplished on the basis of this finding.

Namely, the present invention provides a transportability improver for pulverized coal, characterized by comprising of a water-soluble inorganic salt and by being applied to pulverized coal which is prepared from raw coal having an average HGI of 30 or above and is in a dry state at the injection port of a metallurgical or combustion furnace, and an improved pulverized coal comprising such a transportability improver and the pulverized coal. Further, the present invention also provides a method for operating a metallurgical or combustion furnace, characterized by injecting such a transportability improver and the pulverized coal into the furnace.

In other words, the present invention relates to a method for improving the transportability of pulverized coal characterized in that a water-soluble inorganic salt is applied to pulverized coal prepared from raw coal having an average HGI of 30 or above as the transportability improver and that the pulverized coal thus treated with the improver is in a dry state at the injection port of a metallurgical or combustion furnace.

Further, the present invention relates to a transportability improver for pulverized coal, characterized by comprising a water-soluble inorganic salt, by being applied to pulverized coal prepared from raw coal having an average HGI of 30 or above, and by satisfying the requirement that the pulverized coal treated with the improver must be in a dry state at the injection port of a metallurgical or combustion furnace, and an improved pulverized coal characterized by being prepared by making a water-soluble inorganic salt adhere to the surface of pulverized coal prepared from raw coal having an average HGI of 30 or above and by being in a dry state at the injection port of a metallurgical or combustion furnace.

Additionally, the present invention relates to a method for operating a metallurgical or combustion furnace, characterized by injecting an improved pulverized coal prepared by making a water-soluble inorganic salt adhere to the surface of pulverized coal prepared from raw coal having an average HGI of 30 or above into a metallurgical or combustion furnace through the injection port under the condition that the improved pulverized coal is in a dry state at the injection port.

Furthermore, the present invention also Includes use of a water-soluble inorganic salt in transporting dry pulverized coal prepared from raw coal having an average HGI of 30 or above, and a method for transporting pulverized coal, characterized in that a water-soluble inorganic salt is applied to pulverized coal prepared from raw coal having an average HGI of 30 or above as the transportability improver and that the pulverized coal thus treated with the improver is in a dry state at the injection port of a metallurgical or combustion furnace.

It is preferable that when the inorganic salt is applied to the pulverized coal in an amount of 0.3% by weight (based on the coal on dry basis), the quantity of triboelectrification of the pulverized coal be decreased either by at least (the average HGI of the raw coal)×0.007 $\mu$C/g or to 2.8 $\mu$C/g or below.

It is desirable that the addition of the inorganic salt is conducted before and/or during the pulverization of the raw coal.

It is also desirable that the pulverized coal is one prepared by pulverizing the raw coal at a water concentration in coal ranging from 0.5 to 30% by weight, more desirably 1.0 to 30% by weight.

It is desirable that the pulverized coal contains coal particles 106 $\mu$m or below in diameter in an amount of 10% by weight or above, or more desirably 40% by weight or above.

It is desirable that the amount of the inorganic salt adhering to the pulverized coal is 0.01 to 10% by weight, more desirably 0.05 to 5% by weight based on the coal by dry basis.

It is desirable that the decrease in the quantity of triboelectrification of the pulverized coal is equal to (the average HGI of the raw coal)ty×0.007 $\mu$C/g or above.

It is preferable that the improved pulverized coal bear 0.01 to 10% by weight (based on the coal by dry basis) of the inorganic salt adhering thereto and exhibit a quantity of triboelectrification of 2.8 $\mu$C/g or below.

It is desirable that the inorganic salt is one exhibiting a solubility of 0.1 or above, more desirably 1 or above, most desirably 10 or above at 25° C.

The term "water-soluble inorganic salt" used in this description refers to an inorganic salt exhibiting a solubility (i.e., the mass (g) of the inorganic salt contained in 100 g of the saturated solution thereof) of 0.1 or above at 25° C., preferably one exhibiting a solubility of 1 or above at 25° C., still preferably one exhibiting a solubility of 10 or above at 25° C. The use of an inorganic salt exhibiting a solubility of less than 0.1 is undesirable, because the effect is not commensurate with the amount thereof used.

The method for operating a metallurgical or combustion furnace by the use of the transportability improver according to the present invention is characterized by applying 0.01 to 10% by weight of the transportability improver to the pulverized coal to thereby lower the quantity of triboelectrification of the pulverized coal and injecting the resulting pulverized coal into the furnace through the injection port, with the addition of the improver in an amount of 0.05 to 5% by weight being preferable from the standpoint of transportability-improving effect. It is desirable from the standpoint of transportability-improving effect that the amount of the improver to be added is 0.01% by weight or above based on the pulverized coal. The addition of the improver in an amount exceeding 10% by weight fail in attaining the effect commensurate with the amount, being uneconomical.

The pulverized coal according to the present invention is one which is prepared from raw coal having an average HGI of 30 or above and is in a dry state at the injection port of a metallurgical or combustion furnace. The term "dry state" used in this description refers to a state wherein the water content is 0.1 to 10% by weight as determined by the air-drying weight loss method stipulated in JIS M8812-1984. Pulverized coal containing too much water is unusable as the fuel to be injected into a metallurgical or combustion furnace.

Although pulverized coal prepared from raw coal having an average HGI of 30 or above is poor in transportability, smooth transportation of such pulverized coal can be attained by using the transportability improver according to the present invention. Further, the present invention is effective even for pulverized coal prepared from raw coal having an average HGI of 50 or above which has been believed to be difficult of conventional pneumatic transportation.

That is, the present invention provides a method for improving the transportability of pulverized coal, characterized in that a water-soluble inorganic salt is applied to pulverized coal prepared from raw coal having an average HGI of 30 or above as the transportability improver and that the pulverized coal thus treated with the salt is in a dry state at the injection port of a metallurgical or combustion furnace.

Further, the present invention also provides use of a water-soluble inorganic salt in transporting dry pulverized coal prepared from raw coal having an average HGI of 30 or above.

The term "HGI" used in this description is an abbreviation of "Hardgrove Grinding Index (grindability index)" and refers to an index of grinding resistance of coal as defined in ASTM D409.

Additionally, the inventors of the present invention have elucidated that the above problems of pulverized coal are resulting from electrification among fine coal particles, and have found that the above problems can be solved by lowering the quantity of triboelectrification of pulverized coal and that the fluidity index and pipelining characteristics of pulverized coal significantly depend on the quantity of triboeletrification among fine coal particles.

Precisely, pulverized coal poor in transportability comprises fine coal particles having diameters nearly equivalent to the mean particle diameter of the pulverized coal and finer coal particles adhering to the fine coal particles, while pulverized coal excellent in transportability little contains such finer coal particles. When such finer coal particles adhere to fine coal particles strongly, the resulting pulverized coal will be poor in fluidity, for the following reasons:

① the resulting pulverized coal has a distorted apparent shape, and

② the finer coal particles adhering to one fine coal particle adhere also to another fine coal particle strongly to act like a binder.

The quantity of triboelectrification between fine coal particles 38 $\mu$m or above in size and those 38 $\mu$m or below in size was determined by the blow-off method (generally used in determining the quantity of triboelectrificaition between different kinds of substances having particle size distributions different from each other, for example, between toner and carrier) to thereby ascertain that the force between the finer coal particles and the fine coal particles is due to Coulomb attractive force. Further, it has been found that when the decrease in the quantity of triboelectrification of pulverized coal is equal to [the average HGI of raw coal]× 0.007 $\mu$C/g or above, the transportability of the pulverized coal is improved. Furthermore, the transportability of pulverized coal which has a quantity of triboelectrification exceeding 2.8 $\mu$C/g and is very poor in transportability can be improved by adding the transportability improver to the pulverized coal to thereby lower the quantity of triboelectrification to 2.8 $\mu$C/g or below. The term "quantity of triboelectrificaiton" used in this description refers to a value determined by the method which will be described in Example in detail.

In the present invention, fluidity index and pressure drop in pipelining which will be described in Example in detail were used as indications of the transportability of pulverized coal. The fluidity index permits the simulation of the discharge characteristics from a hopper or the like, while the pressure drop permits that of the flow characteristics in pneumatic transportation piping. In order to attain an improvement in the transportability, it is necessary that the fluidity index is enhanced by 3 points or more and the pressure drop is reduced by 3 $mmH_2O/m$ or more. With respect to pulverized coal so poor in transportability as to cause choking in actual equipment, it is preferable that the fluidity index be enhanced to 40 or above and the pressure drop be lowered to 16 $mmH_2O/m$ or below.

Further, the inventors of the present invention have made additional studies and have found that water-soluble inorganic salts are useful as compounds which lower the quantity of triboelectrification of pulverized coal to improve the transportability of the coal.

The water-soluble inorganic salts to be used in the present invention include those represented by the general formula: $MaXb.cH_2O$.

In the above general formula, M is selected from among Ag, Al, Ba, Be, Ca, Cd, Co, Cr, Cs, Cu, Fe, H, Hg, K, Li, Mg, Mn, Na, $NH_4$, Ni, Pb, Sn, Sr, and Zn.

Further, X is selected from among $Al(SO_4)_2$, $AlF_6$, $B_{10}O_{16}$, $B_2O_5$, $B_3F_9$, $B_4O_7$, $B_4O_7$, $B_6O_{10}$, $BeF_4$, $BF_4$, $BO_2$, $BO_3$, Br, BrO, $BrO_3$, $Cd(SO_3)$, $CdBr_6$, $CdCl_3$, $CdCl_6$, $CdI_3$, $CdI_4$, Cl, ClO, $ClO_2$, $ClO_3$, $ClO_4$, CN, $Co(CN)_6$, $Co(SO_4)_2$, $CO_3$, $Cr_2O_7$, $Cr_3O_{10}$, $Cr_4O_{13}$, $CrO_4$, $Cu(SO_4)$, $Cu(SO_4)_2$, $CuCl_4$, F, $Fe(CN)_6$, $Fe(SO_4)_2$, $H_2P_2O_5$, $H_2P_2O_6$, $H_2P_2O_7$, $H_2PO_2$, $H_2PO_3$, $H_2PO_4$, $H_3P_2O_6$, $H_5(P_2O_6)_2$, $H_5P_2O_8$, $HCO_3$, $HF_2$, $HN_2O$, $HP_2O_6$, $HPO_3$, $HPO_4$, $HS_2O_5$, $HSO_3$, $HSO_4$, I, IO, $IO_3$, $MgCl_6$, $MnO_4$, $Mo_3O_{10}$, $MoO_4$, $N_2O_2$, NCS, $NH_4SO_4$, $Ni(SO_4)_2$, $NO_2$, $NO_3$, OH, $P_2O_6$, $P_2O_7$, $Pb(SO_4)_2$, $PH_2O_2$, $PO_2$, $PO_3$, $PO_4$, S, $S_2O_3$, $S_2O_4$, $S_2O_6$, $S_2O_7$, $S_2O_8$, $S_3O_6$, $S_4O_6$, $S_5O_6$, $S_6O_6$, SH, $Si_2O_5$, $Si_3O_7$, $SiF_6$, $SiO_3$, $SiO_4$, $Sn(OH)_3$, $Sn(OH)_6$, $SnCl_4$, $SnCl_6$, $SO_3$, $SO_3NH_2$, and $SO_4$, and a and b are each an integer depending on the valencies of M and X. These salts may take the form of hydrates represented by the above general formula wherein c is an integer of 1 or above.

Specific examples of the water-soluble inorganic salt to be used in the present invention include the following:

(1)
$AgClO_3$, $AgClO_4$, AgF, $AgNO_3$, $AgBrO_3$, $AgNO_2$, $Ag_2SO_4$ (2)
$Al(NO_3)_3$, $Al_2(SO_4)_3$, $Al(ClO_4)_3$, $AlF_3$ (3)
$BaBr_2$, $BaCl_2$, $Ba(ClO_3)_2$, $Ba(ClO_4)_2$, $BaI_2$, $Ba(NO_2)_2$, $Ba(SH)_2$, $BaS_2O_6$, $Ba(SO_3NH_2)_2$, $BaS_2O_8$, $Ba(BrO_3)_2$, $BaF_2$, $Ba(NO_3)_2$, $Ba(OH)_2$, $BaS_2O_3$ (4)
$BeCl_2$, $Be(ClO_4)_2$, $Be(NO_3)_2$, $BeSO_4$, $BeF_2$ (5)
$CaBr_2$, $CaCl_2$, $Ca(ClO_3)_2$, $Ca(ClO_4)_2$, $CaCr_2O_7$, $Ca_2Fe(CN)_6$, $CaI_2$, $Ca(NO_2)_2$, $Ca(NO_3)_2$, $CaS_2O_3$, $Ca(SO_3NH_2)_2$, $Ca(ClO)_2$, $CaSiF_6$, $Ca(OH)_2$, $CaSO_4$, $CaB_6O_{11}$, $CaCrO_4$, $Ca(IO_3)_2$ (6)
$CdBr_2$, $CdCl_2$, $Cd(ClO_3)_2$, $Cd(ClO_4)_2$, $CdI_2$, Cd, $(NO_3)_2$, $CdSO_4$, $CdMgCl_6$ (7)
$CoBr_2$, $CoCl_2$, $Co(ClO_3)_2$, $Co(ClO_4)_2$, $COI_2$, $Co(NO_3)_2$, $CoSO_4$, $Co(IO_3)_2$, $Co(NO_2)_2$ (8)
$Cr(ClO_4)_2$, $Cr(NO_3)_3$, $CrCl_3$, $CrSO_4$ (9)
CsCl, CsI, $CsNO_3$, $Cs_2SO_4$, $CsAl(SO_4)_2$, $CsClO_3$, $CsClO_4$

(10)
CuBr, $CrCl_2$, $Cu(ClO_3)_2$, $Cu(NO_3)_2$, $CuSO_4$, $CuSiF_6$, $Cu(ClO_4)_2$, $CUS_2O_6$, $Cu(SO_3NH_2)_2$

(11)
$FeBr_2$, $FeCl_2$, $FeCl_2$, $Fe(ClO_4)_2$, $Fe(ClO_4)_3$, $Fe(NO_3)_2$, $Fe(NO_3)_3$, $FeSO_4$, $FeSiF_6$, $FeF_3$

(12)
$Hg(ClO_4)_2$, $Hg_2(ClO_4)_2$
$HgBr_2$, $Hg(CN)_2$, $HgCl_2$

(13)
$K_2BeF_4$, KBr, $K_2CO_3$, $K_2Cd(SO_3)_2$, KCl, $K_2CrO_4$, KF, $K_3Fe(CN)_6$, $K_4Fe(CN)_6$, $K_2Fe(SO_4)_2$, $KHCO_3$, $KHF_2$, $KH_2PO_4$, $KHSO_4$, KI, $K_2MoO_4$, $KNO_2$, $KNO_3$, KOH, $K_3PO_4$, $K_4P_2O_7$, $K_2SO_3$, $K_2S_2O_3$, $K_2S_2O_5$, $K_2S_2O_8$, $KSO_3NH_2$, KCN, $KPH_2O_2$, $KHPHO_3$, $KH_3P_2O_6$, $KH_5P_2O_8$, $K_2H_2P_2O_6$, $K_3HP_2O_6$, $K_3H_5(P_2O_6)_2$, $K_2S_3O_6$, $K_2S_4O_6$, $K_2S_5O_6$, $K_2SnCl_4$, $K_4SnCl_6$, $K_2Sn(OH)_3K_3AlF_6$, $KAl(SO_4)_2$, $KBF_4$, $KBrO_3$, $KClO_3$, $KClO_4$, $K_2Co(SO_4)_2$, $K_2Cr_2O_7$, $K_2CU(SO_4)_2$, $KIO_3$, $KIO_4$, $KMnO_4$, $K_2SO_4$, $K_2S_2O_6$, $KBO_3$, $K_2O_4B_7$, $K_2B_{10}O_{16}$

(14)
LiBr, LiCl, $LiClO_3$, $LiClO_4$, LiI, LiOH, $LiSO_4$, $LiClO_3$, $Li_2CrO_4$, $Li_2Cr_2O_7$, $LiH_2PO_4$, $LiMnO_4$, $LiMoO_4$, $LiNH_4SO_4$, $LiNO_2$, $Li_2CO_3$, LiF, $LiHPO_3$, $LiIO_3$, $LiNO_2$, $LiNO_3$, LiNCS, $LiBO_2$, $Li_2B_2O_5$, $Li_2B_4O_7$, $LiB_{10}O_{16}$, $Li_4P_2O_6$

(15)
$MgBr_2$, $Mg(BrO_3)_2$, $MgCl_2$, $Mg(ClO_3)_2$, $Mg(ClO_4)_2$, $MgCrO_4$, $MgCr_2O_7$, $MgI_2$, $Mg(NO_2)_2$, $Mg(NO_3)_2$, $MgSO_4$, $MgS_2O_3$, $MgMoO_4$, $MgS_2O_6$, $Mg(SO_3NH_2)_2$, $MgSiF_6$, $MgCO_3$, $Mg(IO_3)_2$, $Mg(IO_3)_2$, $MgSO_3$

(16)
$MnBr_2$, $MnCl_2$, $Mn(NO_3)_2$, $MnSO_4$, $Mn(ClO_4)_2MnF_2$, $Mn(IO_3)_2$

(17)
$NH_4BF_4$, $NH_4Br$, $NH_4Cl$, $NH_4ClO_4$, $(NH_4)_2Co(SO_4)_2$, $(NH_4)_2CrO_4$, $(NH_4)_2Cr_2O_7$, $(NH_4)_2Cu(SO_4)_2$, $NH_4F$, $(NH_4)_2Fe(SO_4)_2$, $NH_4HCO_3$, $NH_4HF_2$, $NH_4H_2PO_4$, $(NH_4)_2HPO_4$, $NH_4I$, $NH_4NO_2$, $NH_4NO_3$, $(NH_4)_2Pb(SO_4)_2$, $(NH_4)_2SO_3$, $(NH_4)_2SO_4$, $(NH_4)_2S_2O_5$, $(NH_4)_2S_2O_6$, $(NH_4)_2S_2O_8$, $NH_4SO_3NH_2$, $(NH_4)_2SiF_6$, $(NH_4)_2SnCl_4$, $NH_4B_3F_9$, $(NH_4)_2CO_3$, $NH_4CdCl_3$, $(NH_4)_4CdBr_6$, $(NH_4)_4CdCl_6$, $NH_4CdI_3$, $(NH_4)_2CdI_4$, $(NH_4)_2CuCl_4$, $(NH_4)_4Fe(CN)_6$, $(NH_4)_2Fe_2(SO_4)_2$, $NH_4PH_2O_2$, $(NH_4)_2H_2P_2O_7$, $(NH_4)_3HP_2O_7$, $(NH_4)_3PO_4$, $(NH_4)S_3O_6$, $(NH_4)_2S_4O_6$, $NH_4SnCl_3$, $(NH_4)_4SnCl_6$, $NH_4OH$, $NH_4Al(SO_4)_2$, $(NH_4)_2B_4O_7$, $NH_4Cr(SO_4)_2$, $(NH_4)_2Ni(SO_4)_2$, $(NH_4)_3AlF_6$, $(NH_4)_2B_{10}O_{16}$, $(NH_4)_2BeF_4$, $NH_4IO_3$, $NH_4IO_4$, $NH_4MnO_4$

(18)
$NaAl(SO_4)_2$, $NaBO_2$, NaBr, $NaBrO_3$, NaCN, $Na_2CO_3$, NaCl, NaClO, $NaClO_2$, $NaClO_3$, $NaClO_4$, $Na_2CrO_4$, $Na_2Cr_3O_{10}$, $Na_4CrO_5$, $Na_4Fe(CN)_6$, $NaH_2PO_4$, NaI, $NaMnO_4$, $Na_2MoO_4$, $NaNO_2$, $NaNO_3$, NaOH, $Na_2PHO_3$, $Na_2SO_3$, $Na_2S_2O_3$, $NaS_2O_5$, $NaSO_3NH_2$, $Na_2Sn(OH)_6$, $Na_2Cr_4O_{13}$, $NaHPHO_3$, $NaHSO_4$, $NaPH_2O_2$, $Na_2S_2O_4$, $Na_2S_3O_6$, $Na_2S_4O_6$, $Na_2S_5O_6$, $Na_2SiF_6$, $Na_2SO_4$, $Na_2B_4O_7$, $Na_2B_{10}O_{16}$, NaF, $NaHCO_3$, $Na_2HPO_4$, $Na_2H_2P_2O_6$, $Na_2H_2P_2O_7$, $Na_3HP_2O_6$, $Na_3HP_2O_7$, $NaIO_3$, $NaIO_4$, $Na_2Mo_3O_{10}$, $Na_3PO_4$, $Na_4P_2O_6$, $Na_3PO_4$, $NaP_2O_7$, $Na_4P_2O_7$, $Na_5P_3O_{10}$, $Na_2SO_4$, $Na_2S_2O_6$, $Na_2SiF_6$ (19)

$NiBr_2$, $NiCl_2$, $Ni(ClO_3)_2$, $Ni(ClO_4)_2$, $NiI_2$, $Ni(NO_3)_2$, $NiSO_4$, $NiF_2$, $Ni(IO_3)_2$ (20)

$Pb(No_3)_2$, $PbSiF_6$, $Pb(ClO_3)_2$, $Pb(ClO_4)_2$, $Pb_3[Co(CN_6)]_2$, $PbBr_2$, $PbCl_2$, $Pb(ClO_2)_2$, $Pb(SO_3NH_2)_2$ (21)

$SnSO_4$, $SnCl_2$, $SnCl_4$ (22)

$SrBr_2$, $Sr(BrO_3)_2$, $SrCl_2$, $Sr(ClO_3)_2$, $Sr(ClO_4)_2$, $SrCrO_4$, $SrI_2$, $Sr(NO_2)_2$, $Sr(NO_3)_2$, $SrS_2O_3$, $Sr(ClO_2)_2$, $SrS_2O_6$, $SrS_4O_6$, $Sr(IO_3)_2$, $Sr(OH)_2$, $Sr(MnO_4)_2$, $SrSiF_6$ (23)

$ZnBr_2$, $ZnCl_2$, $Zn(ClO_3)_2$, $Zn(ClO_4)_2$, $ZnI_2$, $Zn(NO_3)_2$, $ZnSO_4$, $ZnSiF_6$, $Zn(SO_3NH_2)_2$, $Zn(ClO_2)_2$, $ZnF_2$, $Zn(IO_3)_2$, $ZnSO_3$ (24)

$HNO_3$, $HNO_2$, $H_2N_2O_2$, $H_2CrO_4$, $H_2Cr_2O_7$, $H_2Cr_3O_{10}$, $H_2Cr_4O_{13}$, $H_2SO_4$, $H_2SO_7$, $H_2S_2O_8$, $H_2SO_5$, $H_2S_2O_3$, $H_2S_2O_2$, $H_3S_3O_6$, $H_3S_4O_6$, $H_3S_5O_6$, $H_3S_6O_6$, $H_2S_2O_6$, $H_2SO_3$, $H_2S_2O_5$, $H_2S_2O_4$, $H_2SO_2$, HClO, $HClO_2$, $HClO_3$, $HClO_4$, HBrO, $HBrO_3$, HIO, $HIO_3$, $H_5IO_6$, $H_2CO_3$, $H_3PO_4$, $H_4P_2O_6$, $H_3PO_3$, $H_3PO_2$, $H_4P_2O_7$, $H_2P_2O_6$, $H_4P_4O_{12}$, $H_4P_2O_5$, $H_4P_2O_8$, HF, HCl, HBr, HI, $H_2CrO_4$, $H_2Cr_2O_7$, $H_2Cr_3O_{10}$, $H_2Cr_4O_{13}$, $H_2B_2O_5$, $H_2B_4O_7$, $H_2B_6O_{10}$, $HBO_2$, $HBO_3$, HBrO, $HBrO_3$, HCN.

Among these salts, the following are excellent in transportability-improving effect:

$AgClO_3$, $AgClO_4$, AgF, $AgNO_3$, $Al(NO_3)_3$, $Al_2(SO_4)_3$, $Al(ClO_4)_3$, $BaBr_2$, $BaCl_2$, $Ba(ClO_3)_2$, $Ba(ClO_4)_2$, $BaI_2$, $Ba(NO_2)_2$, $Ba(SH)_2$, $BaS_2O_6$, $Ba(SO_3NH_2)_2$, $BaS_2O_8$, $BeCl_2$, $Be(ClO_4)_2$, $Be(NO_3)_2$, $BeSO_4$, $BeF_2$, $CaBr_2$, $CaCl_2$, $Ca(ClO_3)_2$, $Ca(ClO_4)_2$, $CaCr_2O_7$, $Ca_2Fe(CN)_6$, $CaI_2$, $Ca(NO_2)_2$, $Ca(NO_3)_2$, $CaS_2O_3$, $Ca(SO_3NH_2)_2$, $Ca(ClO)_2$, $CaSiF_6$, $CdBr_2$, $CdCl_2$, $Cd(ClO_3)_2$, $Cd(ClO_4)_2$, $CdI_2$, $Cd(NO_3)_2$, $CdSO_4$, $CdMgCl_6$, $CoBr_2$, $COCl_2$, $Co(ClO_3)_2$, $Co(ClO_4)_2$, $CoI_2$, $Co(NO_3)_2$, $CoSO_4$, $Cr(ClO_4)_2$, $Cr(NO_3)_3$, $CrCl_3$, CsCl, CsI, $CsNO_3$, $Cs_2SO_4$, $CuBr_2$, $CrCl_2$, $Cu(ClO_3)_2$, $Cu(NO_3)_2$, $CuSO_4$, $CuSiF_6$, $Cu(ClO_4)_2$, $CuS_2O_6$, $Cu(SO_3NH_2)_2$, $FeBr_2$, $FeCl_2$, $FeCl_3$, $Fe(ClO_4)_2$, $Fe(ClO_4)_3$, $Fe(NO_3)_2$, $Fe(NO_3)_3$, $FeSO_4$, $FeSiF_6$, $Hg(ClO_4)_2$, $Hg_2(ClO_4)_2$, $K_2BeF_4$, KBr, $K_2CO_3$, $K_2Cd(SO_3)_2$, KCl, $K_2CrO_4$, KF, $K_3Fe(CN)_6$, $K_4Fe(CN)_6$, $K_2Fe(SO_4)_2$, $KHCO_3$, $KHF_2$, $KH_2PO_4$, $KHSO_4$, KI, $K_2MoO_4$, $KNO_2$, $KNO_3$, KOH, $K_3PO_4$, $K_4P_2O_7$, $K_2SO_3$, $K_2S_2O_3$, $K_2S_2O_5$, $K_2S_2O_8$, $KSO_3NH_2$, KCN, $KPH_2O_2$, $KHPHO_3$, $KH_3P_2O_6$, $KH_5P_2O_8$, $K_2H_2P_2O_6$, $K_3HP_2O_6$, $K_3H_5(P_2O_6)_2$, $K_2S_3O_6$, $K_2S_4O_6$, $K_2S_5O_6$, $K_2SnCl_4$, $K_4SnCl_6$, $K_2Sn(OH)_3$, LiBr, LiCl, $LiClO_3$, $LiClO_4$, LiI, LiOH, $LiSO_4$, $LiClO_3$, $Li_2CrO_4$, $Li_2Cr_2O_7$, $LiH_2PO_4$, $LiMnO_4$, $LiMoO_4$, $LiNH_4SO_4$, $LiNO_2$, $MgBr_2$, $Mg(BrO_3)_2$, $MgCl_2$, $Mg(ClO_3)_2$, $Mg(ClO_4)_2$, $MgCrO_4$, $MgCr_2O_7$, $MgI_2$, $Mg(NO_2)_2$, $Mg(NO_3)_2$, $MgSO_4$, $MgS_2O_3$, $MgMoO_4$, $MgS_2O_6$, $Mg(SO_3NH_2)_2$, $MgSiF_6$, $MnBr_2$, $MnCl_2$, $Mn(NO_3)_2$, $MnSO_4$, $Mn(ClO_4)_2$, $NH_4BF_4$, $NH_4Br$, $NH_4Cl$, $NH_4ClO_4$, $(NH_4)_2Co(SO_4)_2$, $(NH_4)_2CrO_4$, $(NH_4)_2Cr_2O_7$, $(NH_4)_2Cu(SO_4)_2$, $NH_4F$, $(NH_4)_2Fe(SO_4)_2$, $NH_4HCO_3$, $NH_4HF_2$, $NH_4H_2PO_4$, $(NH_4)_2HPO_4$, $NH_4I$, $NH_4NO_2$, $NH_4NO_3$, $(NH_4)_2Pb(SO_4)_2$, $(NH_4)_2SO_3$, $(NH_4)_2SO_4$, $(NH_4)_2S_2O_5$, $(NH_4)_2S_2O_6$, $(NH_4)_2S_2O_8$, $NH_4SO_3NH_2$, $(NH_4)_2SiF_6$, $(NH_4)_2SnCl_4$, $NH_4B_3F_9$, $(NH_4)_2CO_3$, $NH_4CdCl_3$, $(NH_4)_4CdBr_6$, $(NH_4)_4CdCl_6$, $NH_4CdI_3$, $(NH_4)_2CdI_4$, $(NH_4)_2CuCl_4$, $(NH_4)_4Fe(CN)_6$, $(NH_4)_2Fe_2(SO_4)_2$, $NH_4PH_2O_2$, $(NH_4)_2H_2P_2O_7$, $(NH_4)_3HP_2O_7$, $(NH_4)_3PO_4$, $(NH_4)_2S_3O_6$, $(NH_4)_2S_4O_6$, $NH_4SnCl_3$, $(NH_4)_4SnCl_6$, $NaAl(SO_4)_2$, $NH_4OH$, $NaBO_2$, NaBr, $NaBrO_3$, NaCN, $Na_2CO_3$, NaCl, NaClO, $NaClO_2$, $NaClO_3$, $NaClO_4$, $Na_2CrO_4$, $Na_2Cr_3O_{10}$, $Na_4CrO_5$, $Na_4Fe(CN)_6$, $NaH_2PO_4$, NaI, $NaMnO_4$, $Na_2MoO_4$, $NaNO_2$, $NaNO_3$, NaOH, $Na_2PHO_3$, $Na_2SO_3$, $Na_2S_2O_3$, $NaS_2O_5$, $NaSO_3NH_2$, $Na_2Sn(OH)_6$, $Na_2Cr_4O_{13}$, $NaHPHO_3$, $NaHSO_4$, $NaPH_2O_2$, $Na_2S_2O_4$, $Na_2S_3O_6$, $Na_2S_4O_6$, $Na_2S_5O_6$, $Na_2SiF_6$, $Na_2SO_4$, $NiBr_2$, $NiCl_2$, $Ni(ClO_3)_2$, $Ni(ClO_4)_2$, $NiI_2$, $Ni(NO_3)_2$, $NiSO_4$, $Pb(NO_3)_2$, $PbSiF_6$, $Pb(ClO_3)_2$, $Pb(ClO_4)_2$, $Pb_3[Co(CN)_6]_2$, $SnSO_4$, $SnCl_2$, $SnCl_4$, $SrBr_2$, $Sr(BrO_3)_2$, $SrCl_2$, $Sr(ClO_3)_2$, $Sr(ClO_4)_2$, $SrCrO_4$, $SrI_2$, $Sr(NO_2)_2$, $Sr(NO_3)_2$, $SrS_2O_3$, $Sr(ClO_2)_2$, $SrS_2O_6$, $SrS_4O_6$, $ZnBr_2$, $ZnCl_2$, $Zn(ClO_3)_2$, $Zn(ClO_4)_2$, $ZnI_2$, $Zn(NO_3)_2$, $ZnSO_4$, $ZnSiF_6$, $Zn(SO_3NH_2)_2$, $Zn(ClO_2)_2$, $ZnF_2$, $Zn(IO_3)_2$, $ZnSO_3$, $HNO_3$, $HNO_2$, $H_2N_2O_2$, $H_2CrO_4$, $H_2Cr_2O_7$, $H_2Cr_3O_{10}$, $H_2Cr_4O_{13}$, $H_2SO_4$, $H_2SO_7$, $H_2S_2O_8$, $H_2SO_5$, $H_2S_2O_3$, $H_2S_2O_2$, $H_3S_3O_6$, $H_3S_4O_6$, $H_3S_5O_6$, $H_3S_6O_6$, $H_2S_2O_6$, $H_2SO_3$, $H_2S_2O_5$, $H_2S_2O_4$, $H_2SO_2$, HClO, $HClO_2$, $HClO_3$, $HClO_4$, HBrO, $HBrO_3$, HIO, $HIO_3$, $H_5IO_6$, $H_2CO_3$, $H_3PO_4$, $H_4P_2O_6$, $H_3PO_3$, $H_3PO_2$, $H_4P_2O_7$, $H_2P_2O_6$, $H_4P_4O_{12}$, $H_4P_2O_5$, $H_4P_2O_8$, HF, HCl, HBr, HI, $H_2CrO_4$, $H_2Cr_2O_7$, $H_2Cr_3O_{10}$, $H_2Cr_4O_{13}$, $H_2B_2O_5$, $H_2B_4O_7$, $H_2B_6O_{10}$, $HBO_2$, $HBO_3$, HBrO, $HBrO_3$, and HCN.

Among these salts, the following are more excellent in transportability-improving effect: $BaCl_2$, $CaCl_2$, $Ca(NO_2)_2$, $Ca(NO_3)_2$, $Ca(ClO)_2$, $K_2CO_3$, KCl, $MgCl_2$, $MgSO_4$, $NH_4BF_4$, $NH_4Cl$, $(NH_4)_2SO_4$, $Na_2CO_3$, NaCl, $NaClO_3$, $NaNO_2$, $NaNO_3$, NaOH, $Na_2S_2O_3$, $NaS_2O_5$, $Na_2SO_4$, $HNO_3$, $H_2SO_4$, $H_2CO_3$, and HCl.

These salts may be each used either as such or in a state dissolved in a solvent in a proper concentration. In order to spray such a salt uniformly, it is desirable that the salt is used in a liquefied state. It is favorable from the standpoint of the easiness of drying of the resulting pulverized coal that the concentration is 1% by weight or above. Further, the use of water as the solvent is preferable from the standpoint of the handleability in drying.

The transportability improver for pulverized coal according to the present invention is preferably one which can decrease the quantity of triboelectrification of the pulverized coal either by at least (the average HGI of raw coal)×0.007 $\mu$C/g or to 2.8 $\mu$C/g or below when it is added to the pulverized coal in an amount of 0.3% by weight (based on the coal by dry basis), still preferably one satisfying both.

The transportability improver according to the present invention exhibits the effect even when added at any point of time before, during or after pulverization, or before or after drying, with the addition thereof before and/or during pulverization being preferable. In the case wherein the transportability improver is added before and/or during the pulverization, the effect of the improver can be exhibited, when the water concentration in coal at the pulverization is 0.5 to 30% by weight and the pulverized coal contains at least 10% by weight of coal particles 106 $\mu$m or below in diameter. In particular, it is preferable that the water concentration in coal at the pulverization be 1.0 to 30% by weight and/or the pulverized coal contain at least 40% by weight of coal particles 106 $\mu$m or below in diameter. It is favorable from the standpoint of transportability-improving effect that the water concentration in coal at the pulverization is 0.5% by weight or above. On the other hand, the water concentration in coal exceeding 30% by weight is also unproblematic from the standpoint of the effect. However, the pulverized coal treated with the transportability improver must be dried prior to the use, and such a high water concentration leads to a high load in the drying uneconomically. Further, pulverized coal containing particles 106 $\mu$m or below in diameter in an amount of 10% by weight or below exhibits more excellent transportability than that of the one containing such particles in an amount of 10% by weight or above, so that the addition of the transportability improver of the present invention to the former gives only poor transportability improving effect.

The metallurgical and combustion furnaces according to the present invention include those wherein pulverized coal is used as fuel and/or reducing agent (such as blast furnace, cupola, rotary kiln, melt reduction furnace, cold iron source melting furnace and boiler), dry distillation equipment (such as fluidized-bed dry distillation furnace and gas reforming furnace) and so on.

EFFECTS OF THE INVENTION

According to the present invention, the transportability of pulverized coal prepared from raw coal having an average HGI of 30 or above can be improved by descreasing the quantity of triboelectrification of the pulverized coal to thereby attain the mass-transportation of the pulverized coal. Further, even coals poor in transportability can be improved in the transportability by the addition of the transportability improver of the present invention, which enables the mass-transportation of such coals to permit the use of a greater variety of coals in pulverized coal injection.

On the other hand, the pulverized coal treated with the transportability improver of the present invention to be injected through an injection port is so excellent in fluidity that the bridging in a hopper can be inhibited and that the change with time in the quantity of pulverized coal discharged from a hopper or the deviation in the quantity distributed can be remarkably reduced.

EXAMPLE

Figure 1:
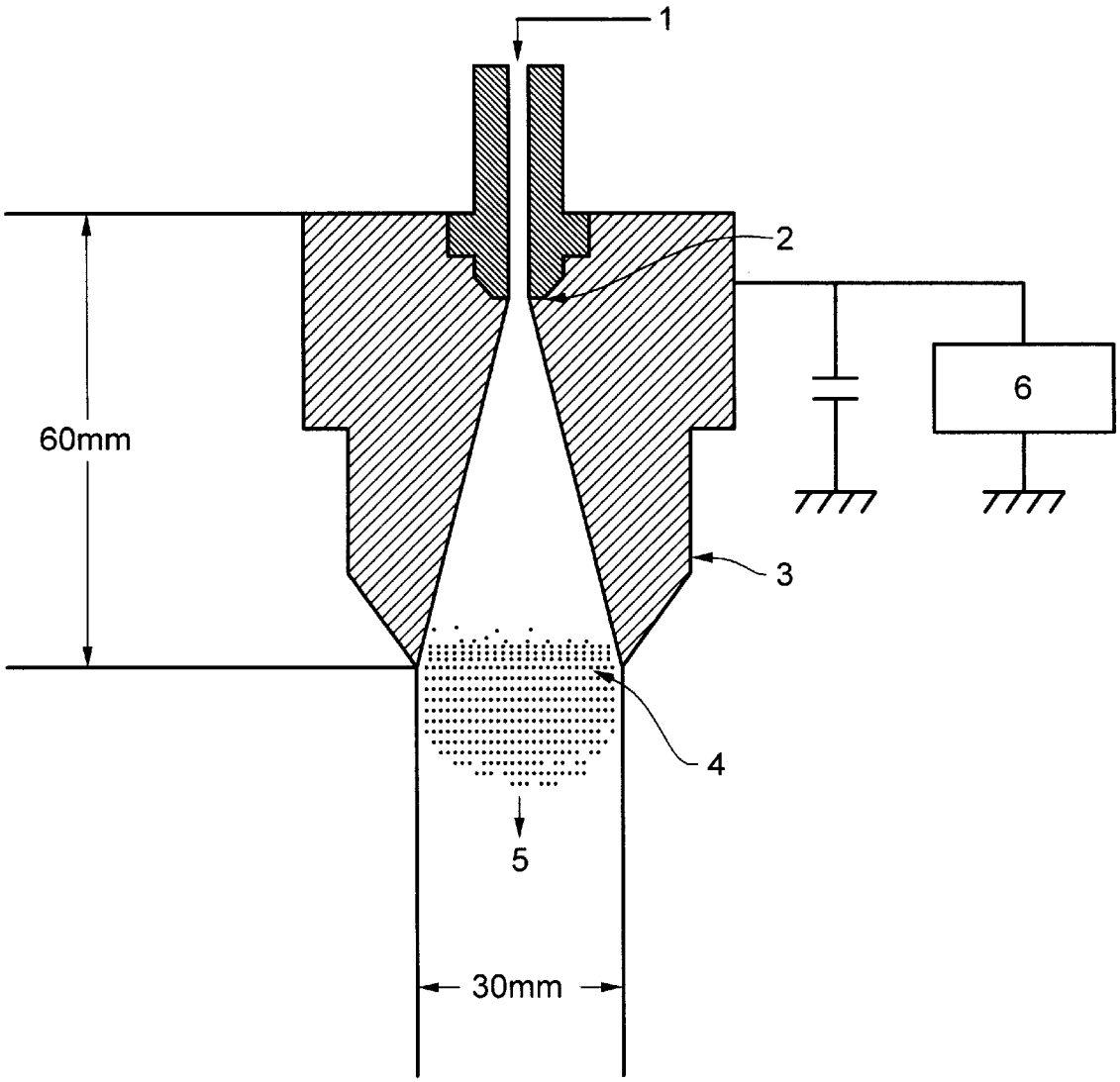
FIG. 1 is a schematic view of the device used in the determination of quantity of triboelectrification.

The present invention will now be described by referring to the following Examples, though the present invention is not limited by them.

Examples 1 to 323 and Comparative Examples 1 to 30

[1] Pulverization of Raw Coal and Preparation of Pulverized Coal for Evaluation

The pulverization of raw coal and the addition of a transportability improver were conducted as follows.

<Addition before pulverization>

1. A raw coal specified in Table is dried to a water concentration of 0.1% by weight.
2. A predetermined amount of the dried raw coal is taken out as a sample.
3. A transportability improver is added to the sample in a predetermined concentration (based on the coal by dry basis).
4. If necessary, water is added to the resulting sample in such an amount as to give a predetermined water concentration in the pulverization step (when the improver is used as an aqueous solution, the quantity of the water contained in the solution must be deducted).
5. If necessary, the resulting sample is dried so as to exhibit a predetermined water concentration in the pulverization step.
6. The resulting sample is pulverized by the use of a small-sized pulverizer SCM-40A (mfd. by Ishizaki Denki) in such a way as to give a pulverized coal containing coal particles 106 μm or below in diameter in a preset amount.
7. The pulverized coal thus obtained is dried or wetted to adjust the water content thereof to 0.5% by weight.

<Addition after pulverization>

1. A raw coal specified in Table is dried to a water concentration to 0.1% by weight.
2. A predetermined amount of the dried raw coal is taken out as a sample.
3. If necessary, water is added to the sample in such an amount as to give a predetermined water concentration in the pulverization step (when the improver is used as an aqueous solution, the quantity of the water contained in the solution must be deducted).
4. If necessary, the resulting sample is dried so as to exhibit a predetermined water concentration in the pulverization step.
5. The resulting sample is pulverized by the use of a small-sized pulverizer SCM-40A (mfd. by Ishizaki Denki) in such a way as to give a pulverized coal containing coal particles 106 μm or below in diameter in a predetermined amount.
6. A transportability improver is added to the pulverized coal in a predetermined concentration (based on the coal by dry basis).
7. The mixture thus obtained is put in a plastic bottle and the resulting bottle is shaken by hand to blend the pulverized coal with the improver.
8. The pulverized coal thus obtained is dried or wetted to adjust the water content thereof to 0.5% by weight.

The content of coal particles 106 μm or below in diameter in pulverized coal is defined by the following formula: Content of particles 106 μm or below in diameter (%)= undersize weight of 106 μm sieve/(undersize weight of 106 μm sieve+oversize weight of 106 μm sieve)×100

In determining the content of such particles, an industrial sieve (mfd. by Iida Kogyo K.K.) as stipulated in JIS Z 8801 which has an opening of 106 μm and a wire diameter of 75 μm was used, and the screening was conducted by vibrating the sieve by the use of a micro-type electromagnetic shaking machine, M-2, (mfd. by Tsutsui Rikagaku Kiki K.K.) at a vibration intensity of 8 (on the vibration controlling scale) for 2 hours.

[2] Evaluation of Pulverized Coal

The pulverized coals prepared above were examined for fluidity index, pipelining characteristics and quantity of triboelectrification according to the following methods to determine the effects of the additives.

In Tables are also given differences (increases or decreases) in fluidity index, pipelining characteristics and quantity of triboelectrification between the case wherein the transportability improver was used and the one wherein it was not used. That is, Tables also show how far the fluidity index was enhanced by the addition of the transportability improver and how far the pressure drop in piping or the quantity of triboelectrification was lowered thereby.

<Method of measuring the quantity of triboelectrification>

The quantity of triboelectrification of each pulverized coal was determined by the use of a blow-off measuring device as shown in FIG. 1, wherein numeral 1 refers to compressed gas, 2 refers to a nozzle, 3 refers to a Faraday gauge, 4 refers to a mesh having an opening of 38 μm, 5 refers to a dust hole, and 6 refers to an electrometer. Such a blow-off device is generally used in determining the quantity of triboelectrification between different kinds of substances having diameters different from each other (for example, between toner and carrier). In the present invention, however, 0.1 to 0.3 g of pulverized coal is placed on the mesh having an opening of 38 μm, and pulverized coal 38 μm or below in size is scattered into the dust hole by making compressed gas (such as air) blow against the resulting mesh at a pressure of 0.6 kgf/cm$^2$ to thereby determine the quantity of triboelectrification of pulverized coal 38 μm or below in size.

<Method of measuring fluidity index>

Fluidity index is an index for evaluating the fluidity of powder, and is determined by converting four factors of powder (angle of repose, compressibility, spatula angle and degree of agglomeration) into indexes respectively and summing up the indexes. Methods of determining the factors and the indexes of the factors are described in detail in "Funtai Kogaku Binran (Handbook of Powder Technology)" (edited by Soc. of Powder Technology, Japan, published by The Nikkan Kogyo Shimbun Ltd., 1987), pp. 151–152. The methodof measuring the four factors will now be described.

1. Angle of repose: determined by filtering powder through a standard sieve (25 mesh), making the undersize portion fall through a funnel on a circular plate 8 mm in diameter and measuring the angle of slope of the deposit formed on the plate.

2. Compressibility: determined by measuring the aerated bulk density $\rho_s$ (g/cm$^3$) of powder and the packed bulk density $\rho_c$ (g/cm$^3$) thereof after 180 tapping runs by the use of a cylindrical container (capacity: 100 cm$^3$) for packing powder and calculating the compressibility ψ (%) from them according to the following formula:

$$\psi=(\rho_c-\rho_s)\times 100/\rho_c(\%)$$

3. Spatula angle: determined by inserting a spatula having a width of 22 mm into a powder deposit, lifting up the spatula, measuring the angle of slope of a deposit thus formed on the spatula, applying a slight shock to the spatula, measuring the angle of slope of a deposit still held on the spatula and averaging out the two angles.

4. Degree of agglomeration: determined by piling up three sieves having different openings (which are 60, 100 and 200 mesh in a descending order), putting 2 g of powder on the top sieve, vibrating these sieves simultaneously, measuring the weights of powder remaining on the sieves respectively and summing up the following three values:

(quantity of powder on the top sieve/2 g)×100, (quantity of powder on the middle sieve/2 g)×100×3/5 and (quantity of powder on the bottom sieve/2 g)×100×1/5

When pulverized coal to be used in the present invention was subjected to such screening, little difference in the quantity of powder was observed among the three sieves, so that the calculation of degree of agglomeration was difficult. In the present invention, accordingly, the fluidity index was evaluated on the basis of the sum total of indexes of angle of repose, compressibility and spatula angle.

<Method of determining transport characteristics in piping>

Figure 2:
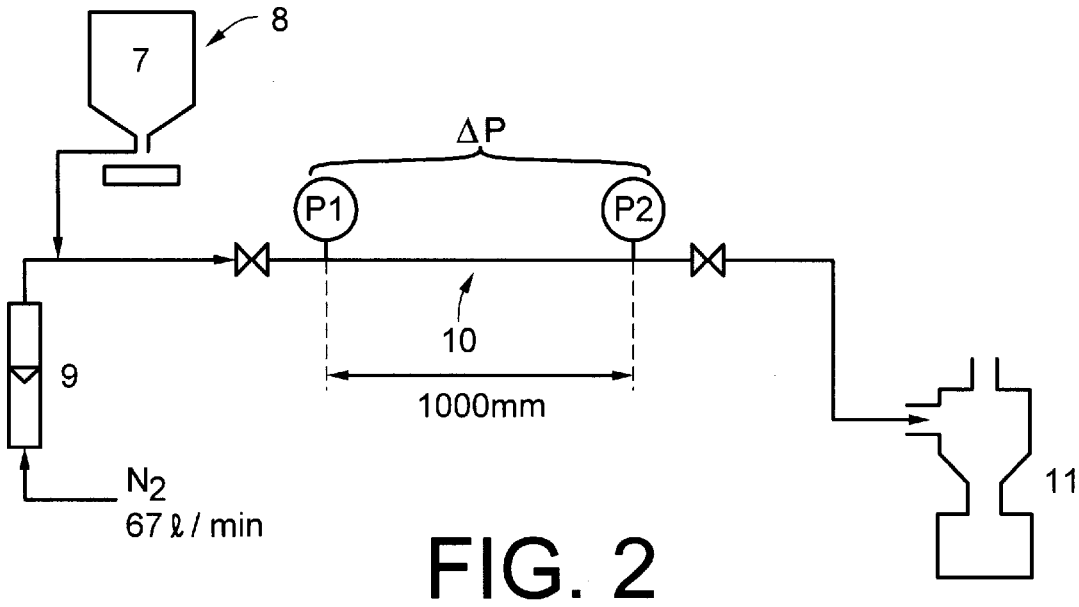
FIG. 2 is a schematic view of the equipment used in the determination of transport characteristics in piping.

The transport characteristics in piping of each pulverized coal were evaluated by measuring the pressure drop by the use of an instrument shown in FIG. 2 according to the method described in CAMP-ISIJ Vol. 6, p.91 (1993). In FIG. 2, numeral 7 refers to pulverized coal, 8 refers to a table feeder, 9 refers to a flowmeter, 10 refers to a horizontal pipe having a diameter of 12.7 mm, and 11 refers to a cyclone. In this instrument, the pulverized coal 7 discharged from the powder feeder 8 was pneumatically transported by a carrier gas to measure the pressure drop between the pressure gauges ($P_1$, $P_2$). The experiment was conducted under the following conditions:

feed rate of pulverized coal: 0.8 kg/min carrier gas: nitrogen ($N_2$)

feed rate of carrier gas: 4 Nm$^3$/h (67 l/min)

transfer time: 6 min

The items of evaluation are as follows:

1. Pressure Drop

Sampling of data is conducted at pressure gauges $P_1$ and $P_2$ at 500 Hz. The pressure drop of each pulverized coal is given in terms of overall average of $P_1-P_2$ over the transport time (6 min).

$$\Delta P=\frac{\sum_{n=1}^{N}(P_{1n}-P_{2n})}{N}$$

The pulverized coals and transportability improvers used are given in Tables 1 to 25 together with the results.

TABLE 1

| | Pulverized coal | | | Transportability improver | | | | Fluidity | | | | | | Cloggig in |
|---|---|---|---|---|---|---|---|---|---|---|---|---|---|---|
| | raw coal | | 106 μm below | | | water | | | | | | | Qty. of | |
| | kind | HGI | (%) | compd. | concn. (%) | timing of addition | concn. at pulverization (%) | angle of repose | compressibility | spatula angle | fluidity index | Pressure drop (mmH$_2$O/m) | tribo-electrifn. (μC/g) | actual equipment |
| Comp. Ex. 1 | coal a | 42 | 95 | not used | — | — | 5.0 | 16 | 9 | 16 | 41 | 13.0 | 0.61 | not observed |
| Comp. Ex. 2 | coal b | 48 | 95 | not used | — | — | 5.0 | 15 | 9 | 16 | 40 | 16.0 | 2.64 | not observed |
| Comp. | coal | 55 | 95 | not | — | — | 5.0 | 12 | 8 | 15 | 35 | 22.1 | 3.15 | obser- |

TABLE 1-continued

| | Pulverized coal | | | Transportability improver | | | | Fluidity | | | | | | Cloggig in |
|---|---|---|---|---|---|---|---|---|---|---|---|---|---|---|
| | raw coal | | 106 μm below | | concn. | timing of | water concn. at pulveriza- | angle of | compres- | spatula | fluidity | Pressure drop | Qty. of tribo-electrifn. | actual equip- |
| | kind | HGI | (%) | compd. | (%) | addition | tion (%) | repose | sibility | angle | index | (mm$H_2O$/m) | (μC/g) | ment |
| Ex. 3 | c | | | used | | | | | | | | | | ved |
| Comp. Ex. 4 | coal d | 67 | 95 | not used | — | — | 5.0 | 12 | 8 | 15 | 35 | 24.0 | 3.76 | obser- ved |
| Comp. Ex. 5 | coal e | 96 | 95 | not used | — | — | 5.0 | 12 | 7 | 15 | 34 | 29.0 | 4.27 | obser- ved |

TABLE 2

| | Pulverized coal | | | Transportability improver | | | | Fluidity | | | | |
|---|---|---|---|---|---|---|---|---|---|---|---|---|
| | raw coal | | 106 μm or | | | | water concn. at | angle | | | | |
| | kind | HGI | below (%) | compd. | concn. (%) | timing of addition | pulverization (%) | of respose | compressibility | spatula angle | fluidity index | increase |
| Comp. Ex. 6 | coal a | 42 | 95 | not used | — | — | 5.0 | 16 | 9 | 16 | 41 | — |
| Comp. Ex. 7 | coal b | 48 | 95 | not used | — | — | 5.0 | 15 | 9 | 16 | 40 | — |
| Comp. Ex. 8 | coal d | 67 | 95 | not used | — | — | 5.0 | 12 | 8 | 15 | 35 | — |
| Comp. Ex. 9 | coal e | 96 | 95 | not used | — | — | 5.0 | 12 | 7 | 15 | 34 | — |
| Comp. Ex. 10 | coal a | 42 | 95 | calcium carbonate ($CaCO_3$) | 0.3 | before pulverization | 5.0 | 17 | 10 | 16 | 43 | 2 |
| Comp. Ex. 11 | coal b | 48 | 95 | calcium carbonate ($CaCO_3$) | 0.3 | before pulverization | 5.0 | 16 | 10 | 16 | 42 | 2 |
| Comp. Ex. 12 | coal d | 67 | 95 | calcium carbonate ($CaCO_3$) | 0.3 | before pulverization | 5.0 | 33 | 9 | 15 | 37 | 2 |
| Comp. Ex. 13 | coal e | 96 | 95 | calcium carbonate ($CaCO_3$) | 0.3 | before pulverization | 5.0 | 13 | 8 | 15 | 36 | 2 |
| Ex. 1 | coal a | 42 | 95 | calcium hydroxide ($CaOH_2$) | 0.3 | before pulverization | 5.0 | 18 | 11 | 17 | 46 | 5 |
| Ex. 2 | coal b | 48 | 95 | calcium hydroxide ($CaOH_2$) | 0.3 | before pulverization | 5.0 | 17 | 11 | 17 | 45 | 5 |
| Ex. 3 | coal d | 67 | 95 | calcium hydroxide ($CaOH_2$) | 0.3 | before pulverization | 5.0 | 14 | 9 | 16 | 39 | 4 |
| Ex. 4 | coal e | 96 | 95 | calcium hydroxide ($CaOH_2$) | 0.3 | before pulverization | 5.0 | 14 | 8 | 16 | 38 | 4 |

| | Pressure drop ($mmH_2O/m$) | | Qty. of triboelectrifn. (μc/g) | |
|---|---|---|---|---|
| | pressure drop | decrease | qty. of triboelectrifn. | decrease |
| Comp. Ex. 6 | 13.0 | — | 0.61 | — |
| Comp. Ex. 7 | 16.0 | — | 2.64 | — |
| Comp. Ex. 8 | 24.0 | — | 3.76 | — |
| Comp. Ex. 9 | 29.0 | — | 4.27 | — |
| Comp. Ex. 10 | 11.9 | 1.1 | 0.41 | 0.20 |
| Comp. Ex. 11 | 14.5 | 1.5 | 2.40 | 0.24 |
| Comp. Ex. 12 | 22.1 | 1.9 | 3.42 | 0.34 |
| Comp. Ex. 13 | 26.9 | 2.1 | 3.81 | 0.46 |
| Ex. 1 | 9.8 | 3.2 | 0.29 | 0.32 |
| Ex. 2 | 12.5 | 3.5 | 2.28 | 0.36 |
| Ex. 3 | 17.2 | 6.8 | 3.25 | 0.51 |
| Ex. 4 | 21.3 | 7.7 | 3.52 | 0.75 |

TABLE 3

| | Pulverized coal | | | Transportability improver | | | | Fluidity | | | | |
|---|---|---|---|---|---|---|---|---|---|---|---|---|
| | raw coal | | 106 μm or | | | | water concn. at | angle | | | | |
| | kind | HGI | below (%) | compd. | concn. (%) | timing of addition | pulverization (%) | of respose | compressibility | spatula angle | fluidity index | increase |
| Ex. 5 | coal a | 42 | 95 | calcium chromate ($CaCrO_4$) | 0.3 | before pulverization | 5.0 | 19 | 12 | 18 | 49 | 8 |
| Ex. 6 | coal b | 48 | 95 | calcium chromate ($CaCrO_4$) | 0.3 | before pulverization | 5.0 | 18 | 12 | 18 | 48 | 8 |
| Ex. 7 | coal d | 67 | 95 | clacium chromate ($CaCrO_4$) | 0.3 | before pulverization | 5.0 | 15 | 11 | 17 | 43 | 8 |
| Ex. 8 | coal e | 96 | 95 | calcium chromate ($CaCrO_4$) | 0.3 | before pulverization | 5.0 | 15 | 10 | 17 | 42 | 8 |
| Comp. Ex. 14 | coal e | 96 | 95 | not used | — | — | 5.0 | 12 | 7 | 15 | 34 | — |
| Ex. 9 | coal e | 96 | 95 | calcium chloride ($CaCl_2$) | 0.01 | before pulverization | 5.0 | 14 | 9 | 16 | 39 | 5 |
| Ex. 10 | coal e | 96 | 95 | calcium chloride ($CaCl_2$) | 0.05 | before pulverization | 5.0 | 15 | 11 | 16 | 42 | 8 |
| Ex. 11 | coal e | 96 | 95 | calcim chloride ($CaCl_2$) | 0.3 | before pulverization | 5.0 | 17 | 12 | 17 | 46 | 12 |
| Ex. 12 | coal e | 96 | 95 | calcium chloride ($CaCl_2$) | 0.5 | before pulverization | 5.0 | 17 | 12 | 17 | 46 | 12 |
| Ex. 13 | coal e | 96 | 95 | calcium chloride ($CaCl_2$) | 1 | before pulverization | 5.0 | 18 | 13 | 18 | 49 | 15 |
| Ex. 14 | coal e | 96 | 95 | calcium chloride ($CaCl_2$) | 5 | before pulverization | 5.0 | 19 | 14 | 21 | 54 | 20 |
| Ex. 15 | coal e | 96 | 95 | calcium chloride ($CaCl_2$) | 10 | before pulverization | 5.0 | 20 | 14 | 21 | 55 | 21 |

| | Pressure drop ($mmH_2O/m$) | | Qty. of triboelectrifn. (μc/g) | |
|---|---|---|---|---|
| | pressure drop | decrease | qty. of triboelectrifn. | decrease |
| Ex. 5 | 9.1 | 3.9 | 0.15 | 0.46 |
| Ex. 6 | 10.2 | 4.8 | 1.10 | 1.54 |
| Ex. 7 | 12.1 | 11.9 | 1.58 | 2.18 |
| Ex. 8 | 13.2 | 15.8 | 1.85 | 2.42 |
| Comp. Ex. 14 | 29.0 | — | 4.27 | — |
| Ex. 9 | 21.0 | 8.0 | 2.87 | 1.40 |
| Ex. 10 | 14.0 | 15.0 | 1.14 | 3.13 |
| Ex. 11 | 10.0 | 19.0 | 0.17 | 4.10 |
| Ex. 12 | 10.2 | 18.8 | 0.15 | 4.12 |
| Ex. 13 | 9.5 | 19.5 | 0.10 | 4.17 |
| Ex. 14 | 8.3 | 20.8 | 0.07 | 4.20 |
| Ex. 15 | 8.3 | 20.8 | 0.06 | 4.21 |

TABLE 4

| | Pulverized coal | | | Transportability improver | | | | Fluidity | | | | |
|---|---|---|---|---|---|---|---|---|---|---|---|---|
| | raw coal | | 106 μm or | | | | water concn. at | angle | | | | |
| | kind | HGI | below (%) | compd. | concn. (%) | timing of addition | pulverization (%) | of respose | compressibility | spatula angle | fluidity index | increase |
| Comp. Ex. 15 | coal c | 55 | 95 | not used | — | — | 5.0 | 12 | 8 | 15 | 35 | — |
| Ex. 16 | coal c | 55 | 95 | calcium chloride ($CaCl_2$) | 0.3 | before pulverization | 0.5 | 14 | 9 | 15 | 38 | 3 |
| Ex. 17 | coal c | 55 | 95 | calcium chloride ($CaCl_2$) | 0.3 | before pulverization | 1.0 | 15 | 11 | 15 | 41 | 6 |
| Ex. 18 | coal c | 55 | 95 | calcium chloride ($CaCl_2$) | 0.3 | before pulverization | 1.5 | 16 | 11 | 16 | 43 | 8 |
| Ex. 19 | coal c | 55 | 95 | calcium chloride ($CaCl_2$) | 0.3 | before pulverization | 3.0 | 16 | 12 | 16 | 44 | 9 |
| Ex. 20 | coal c | 55 | 95 | calcium chloride ($CaCl_2$) | 0.3 | before pulverization | 5.0 | 17 | 12 | 17 | 46 | 11 |
| Ex. 21 | coal c | 55 | 95 | calcium chloride ($CaCl_2$) | 0.3 | before pulverization | 10.0 | 17 | 15 | 17 | 49 | 14 |
| Ex. 22 | coal c | 55 | 95 | calcium chloride ($CaCl_2$) | 0.3 | before pulverization | 30.0 | 17 | 15 | 17 | 49 | 14 |
| Comp. Ex. 16 | coal c | 55 | 70 | not used | — | — | 5.0 | 12 | 9 | 15 | 36 | — |
| Ex. 23 | coal c | 55 | 70 | calcium chloride ($CaCl_2$) | 0.3 | before pulverization | 0.5 | 14 | 10 | 15 | 39 | 3 |
| Ex. 24 | coal c | 55 | 70 | calcium chloride ($CaCl_2$) | 0.3 | before pulverization | 1.0 | 15 | 11 | 16 | 42 | 6 |
| Ex. 25 | coal c | 55 | 70 | calcium chloride ($CaCl_2$) | 0.3 | before pulverization | 1.5 | 17 | 12 | 16 | 45 | 9 |
| Ex. 26 | coal c | 55 | 70 | calcium chloride ($CaCl_2$) | 0.3 | before pulverization | 3.0 | 17 | 13 | 17 | 47 | 11 |
| Ex. 27 | coal c | 55 | 70 | calcium chloride ($CaCl_2$) | 0.3 | before pulverization | 5.0 | 17 | 14 | 17 | 48 | 12 |
| Ex. 28 | coal c | 55 | 70 | calcium chloride ($CaCl_2$) | 0.3 | before pulverization | 10.0 | 18 | 14 | 17 | 49 | 13 |
| Ex. 29 | coal c | 55 | 70 | calcium chloride ($CaCl_2$) | 0.3 | before pulverization | 30.0 | 18 | 15 | 18 | 51 | 15 |

| | Pressure drop ($mmH_2O/m$) | | Qty. of triboelectrifn. (μc/g) | |
|---|---|---|---|---|
| | pressure drop | decrease | qty. of triboelectrifn. | decrease |
| Comp. Ex. 15 | 22.1 | — | 3.15 | — |
| Ex. 16 | 18.5 | 3.6 | 2.55 | 0.60 |
| Ex. 17 | 15.8 | 6.3 | 2.32 | 0.83 |
| Ex. 18 | 12.9 | 9.2 | 1.20 | 1.95 |
| Ex. 19 | 12.1 | 10.0 | 0.53 | 2.62 |
| Ex. 20 | 9.9 | 12.2 | 0.18 | 2.97 |
| Ex. 21 | 8.3 | 13.8 | 0.10 | 3.05 |
| Ex. 22 | 8.2 | 13.9 | 0.05 | 3.10 |
| Comp. Ex. 16 | 20.3 | — | 3.11 | — |
| Ex. 23 | 17.2 | 3.1 | 2.53 | 0.58 |
| Ex. 24 | 15.6 | 4.7 | 2.30 | 0.81 |
| Ex. 25 | 11.3 | 9.0 | 1.10 | 2.01 |
| Ex. 26 | 10.2 | 10.1 | 0.60 | 2.51 |
| Ex. 27 | 9.6 | 10.7 | 0.15 | 2.96 |
| Ex. 28 | 9.3 | 11.0 | 0.09 | 3.02 |
| Ex. 29 | 9.1 | 11.2 | 0.04 | 3.07 |

TABLE 5

| | Pulverized coal | | | Transportability improver | | | | Fluidity | | | | |
|---|---|---|---|---|---|---|---|---|---|---|---|---|
| | raw coal | | 106 μm or | | | | water concn. at | angle | | | | |
| | kind | HGI | below (%) | compd. | concn. (%) | timing of addition | pulverization (%) | of respose | compressibility | spatula angle | fluidity index | increase |
| Comp. Ex. 17 | coal c | 55 | 40 | not used | — | — | 5.0 | 12 | 9 | 15 | 36 | — |
| Ex. 30 | coal c | 55 | 40 | calcium chloride ($CaCl_2$) | 0.3 | before pulverization | 0.5 | 14 | 10 | 15 | 39 | 3 |
| Ex. 31 | coal c | 55 | 40 | calcium chloride ($CaCl_2$) | 0.3 | before pulverization | 1.0 | 16 | 11 | 17 | 44 | 8 |
| Ex. 32 | coal c | 55 | 40 | calcium chloride ($CaCl_2$) | 0.3 | before pulverization | 1.5 | 17 | 14 | 17 | 48 | 12 |
| Ex. 33 | coal c | 55 | 40 | calcium chloride ($CaCl_2$) | 0.3 | before pulverization | 3.0 | 17 | 14 | 18 | 49 | 13 |
| Ex. 34 | coal c | 55 | 40 | calcium chloride ($CaCl_2$) | 0.3 | before pulverization | 5.0 | 18 | 14 | 18 | 50 | 14 |
| Ex. 35 | coal c | 55 | 40 | calcium chloride ($CaCl_2$) | 0.3 | before pulverization | 10.0 | 18 | 16 | 18 | 52 | 16 |
| Ex. 36 | coal c | 55 | 40 | calcium chloride ($CaCl_2$) | 0.3 | before pulverization | 30.0 | 18 | 17 | 18 | 53 | 17 |
| Comp. Ex. 18 | coal c | 55 | 10 | not used | — | — | 5.0 | 15 | 13 | 17 | 45 | — |
| Ex. 37 | coal c | 55 | 10 | calcium chloride ($CaCl_2$) | 0.3 | before pulverization | 0.5 | 16 | 15 | 17 | 48 | 3 |
| Ex. 38 | coal c | 55 | 10 | calcium chloride ($CaCl_2$) | 0.3 | before pulverization | 1.0 | 16 | 16 | 18 | 50 | 5 |
| Ex. 39 | coal c | 55 | 10 | calcium chloride ($CaCl_2$) | 0.3 | before pulverization | 1.5 | 16 | 19 | 18 | 53 | 8 |
| Ex. 40 | coal c | 55 | 10 | calcium chloride ($CaCl_2$) | 0.3 | before pulverization | 3.0 | 17 | 18 | 19 | 54 | 9 |
| Ex. 41 | coal c | 55 | 10 | calcium chloride ($CaCl_2$) | 0.3 | before pulverization | 5.0 | 17 | 19 | 19 | 55 | 10 |
| Ex. 42 | coal c | 55 | 10 | calcium chloride ($CaCl_2$) | 0.3 | before pulverization | 10.0 | 17 | 19 | 19 | 55 | 10 |
| Ex. 43 | coal c | 55 | 10 | calcium chloride ($CaCl_2$) | 0.3 | before pulverization | 30.0 | 18 | 18 | 19 | 55 | 10 |

| | Pressure drop ($mmH_2O/m$) | | Qty. of triboelectrifn. (μc/g) | |
|---|---|---|---|---|
| | pressure drop | decrease | qty. of triboelectrifn. | decrease |
| Comp. Ex. 17 | 20.0 | — | 3.09 | — |
| Ex. 30 | 16.5 | 3.5 | 2.41 | 0.68 |
| Ex. 31 | 10.8 | 9.2 | 2.10 | 0.99 |
| Ex. 32 | 10.1 | 9.9 | 1.10 | 1.99 |
| Ex. 33 | 9.5 | 10.5 | 0.60 | 2.49 |
| Ex. 34 | 9.0 | 11.0 | 0.15 | 2.94 |
| Ex. 35 | 8.3 | 11.7 | 0.09 | 3.00 |
| Ex. 36 | 8.3 | 11.7 | 0.04 | 3.05 |
| Comp. Ex. 18 | 12.9 | — | 1.23 | — |
| Ex. 37 | 8.6 | 4.3 | 0.83 | 0.40 |
| Ex. 38 | 8.5 | 4.4 | 0.31 | 0.92 |
| Ex. 39 | 8.1 | 4.8 | 0.12 | 1.11 |
| Ex. 40 | 8.0 | 4.9 | 0.11 | 1.12 |
| Ex. 41 | 8.1 | 4.8 | 0.08 | 1.15 |
| Ex. 42 | 8.0 | 4.9 | 0.07 | 1.16 |
| Ex. 43 | 8.1 | 4.8 | 0.06 | 1.17 |

TABLE 6

| | Pulverized coal | | | Transportability improver | | | | Fluidity | | | | |
|---|---|---|---|---|---|---|---|---|---|---|---|---|
| | raw coal | | 106 μm or | | | | water concn. at | angle | | | | |
| | kind | HGI | below (%) | compd. | concn. (%) | timing of addition | pulverization (%) | of respose | compressibility | spatula angle | fluidity index | increase |
| Comp. Ex. 19 | coal c | 55 | 95 | not used | — | — | 5.0 | 12 | 8 | 15 | 35 | — |
| Comp. Ex. 20 | coal c | 55 | 70 | not used | — | — | 5.0 | 12 | 9 | 15 | 36 | — |
| Comp. Ex. 21 | coal c | 55 | 40 | not used | — | — | 5.0 | 12 | 9 | 15 | 36 | — |
| Comp. Ex. 22 | coal c | 55 | 10 | not used | — | — | 5.0 | 15 | 13 | 17 | 45 | — |
| Ex. 44 | coal c | 55 | 95 | calcium chloride ($CaCl_2$) | 0.3 | after pulverization | 5.0 | 13 | 9 | 16 | 38 | 3 |
| Ex. 45 | coal c | 55 | 70 | calcium chloride ($CaCl_2$) | 0.3 | after pulverization | 5.0 | 14 | 9 | 16 | 39 | 3 |
| Ex. 46 | coal c | 55 | 40 | calcium chloride ($CaCl_2$) | 0.3 | after pulverization | 5.0 | 14 | 9 | 16 | 39 | 3 |
| Ex. 47 | coal c | 55 | 10 | calcium chloride ($CaCl_2$) | 0.3 | after pulverization | 5.0 | 18 | 13 | 17 | 48 | 3 |

| | Pressure drop ($mmH_2O/m$) | | Qty. of triboelectrifn. (μc/g) | |
|---|---|---|---|---|
| | pressure drop | decrease | qty. of triboelectrifn. | decrease |
| Comp. Ex. 19 | 22.1 | — | 3.15 | — |
| Comp. Ex. 20 | 20.3 | — | 3.11 | — |
| Comp. Ex. 21 | 20.0 | — | 3.09 | — |
| Comp. Ex. 22 | 12.9 | — | 1.23 | — |
| Ex. 44 | 19.0 | 3.1 | 2.52 | 0.63 |
| Ex. 45 | 17.2 | 3.1 | 2.51 | 0.60 |
| Ex. 46 | 16.9 | 3.1 | 2.45 | 0.64 |
| Ex. 47 | 9.8 | 3.1 | 0.73 | 0.50 |

TABLE 7

| | Pulverized coal | | | Transportability improver | | | | Fluidity | | | | |
|---|---|---|---|---|---|---|---|---|---|---|---|---|
| | raw coal | | 106 μm or | | concn. | timing of | water concn. at pulverization | angle of | compress- | spatula | fluidity | |
| | kind | HGI | below (%) | compd. | (%) | addition | (%) | respose | ibility | angle | index | increase |
| Comp. Ex. 23 | coal e | 96 | 95 | not used | — | — | 5.0 | 12 | 7 | 15 | 34 | — |
| Ex. 48 | coal e | 96 | 95 | calcium chloride ($CaCl_2$) | 0.3 | before pulverization | 0.5 | 14 | 8 | 15 | 37 | 3 |
| Ex. 49 | coal e | 96 | 95 | calcium chloride ($CaCl_2$) | 0.3 | before pulverization | 1.0 | 15 | 10 | 15 | 40 | 6 |
| Ex. 50 | coal e | 96 | 95 | calcium chloride ($CaCl_2$) | 0.3 | before pulverization | 1.5 | 16 | 11 | 16 | 43 | 9 |
| Ex. 51 | coal e | 96 | 95 | calcium chloride ($CaCl_2$) | 0.3 | before pulverization | 3.0 | 16 | 12 | 16 | 44 | 10 |
| Ex. 52 | coal e | 96 | 95 | calcium chloride ($CaCl_2$) | 0.3 | before pulverization | 5.0 | 17 | 12 | 17 | 46 | 12 |
| Ex. 53 | coal e | 96 | 95 | calcium chloride ($CaCl_2$) | 0.3 | before pulverization | 10.0 | 17 | 14 | 17 | 48 | 14 |
| Ex. 54 | coal e | 96 | 95 | calcium chloride ($CaCl_2$) | 0.3 | before pulverization | 30.0 | 17 | 14 | 17 | 48 | 14 |
| Comp. Ex. 24 | coal e | 96 | 70 | not used | — | — | 5.0 | 13 | 7 | 15 | 35 | — |
| Ex. 55 | coal e | 96 | 70 | calcium chloride ($CaCl_2$) | 0.3 | before pulverization | 0.5 | 14 | 9 | 15 | 38 | 3 |
| Ex. 56 | coal e | 96 | 70 | calcium chloride ($CaCl_2$) | 0.3 | before pulverization | 1.0 | 15 | 10 | 16 | 41 | 6 |
| Ex. 57 | coal e | 96 | 70 | calcium chloride ($CaCl_2$) | 0.3 | before pulverization | 1.5 | 17 | 12 | 16 | 45 | 10 |
| Ex. 58 | coal e | 96 | 70 | calcium chloride ($CaCl_2$) | 0.3 | before pulverization | 3.0 | 17 | 13 | 17 | 47 | 12 |
| Ex. 59 | coal e | 96 | 70 | calcium chloride ($CaCl_2$) | 0.3 | before pulverization | 5.0 | 17 | 14 | 17 | 48 | 13 |
| Ex. 60 | coal e | 96 | 70 | clacium chloride ($CaCl_2$) | 0.3 | before pulverization | 10.0 | 18 | 14 | 17 | 49 | 14 |
| Ex. 61 | coal e | 96 | 70 | calcium chloride ($CaCl_2$) | 0.3 | before pulverization | 30.0 | 18 | 14 | 18 | 50 | 15 |

| | Pressure drop ($mmH_2O/m$) | | Qty. of triboelectrifn. (μc/g) | |
|---|---|---|---|---|
| | pressure drop | decrease | qty. of triboelectrifn. | decrease |
| Comp. Ex. 23 | 29.0 | — | 4.27 | — |
| Ex. 48 | 26.0 | 3.0 | 3.40 | 0.87 |
| Ex. 49 | 15.9 | 13.1 | 2.51 | 1.76 |
| Ex. 50 | 13.0 | 16.0 | 1.21 | 3.06 |
| Ex. 51 | 12.3 | 16.7 | 0.54 | 3.73 |
| Ex. 52 | 10.0 | 19.0 | 0.17 | 4.10 |
| Ex. 53 | 8.5 | 20.5 | 0.10 | 4.17 |
| Ex. 54 | 8.3 | 20.7 | 0.05 | 4.22 |
| Comp. Ex. 24 | 22.0 | — | 3.95 | — |
| Ex. 55 | 18.5 | 3.5 | 3.15 | 0.80 |
| Ex. 56 | 15.8 | 6.2 | 2.75 | 1.20 |
| Ex. 57 | 12.1 | 9.9 | 0.56 | 3.39 |
| Ex. 58 | 10.3 | 11.7 | 0.21 | 3.74 |
| Ex. 59 | 9.5 | 12.5 | 0.12 | 3.84 |
| Ex. 60 | 9.2 | 12.8 | 0.12 | 3.83 |
| Ex. 61 | 9.0 | 13.0 | 0.07 | 3.88 |

TABLE 8

| | Pulverized coal | | | Transportability improver | | | | Fluidity | | | | |
|---|---|---|---|---|---|---|---|---|---|---|---|---|
| | raw coal | | 106 μm or | | concn. | timing of | water concn. at pulverization | angle of | compress- | spatula | fluidity | |
| | kind | HGI | below (%) | compd. | (%) | addition | (%) | respose | ibility | angle | index | increase |
| Comp. | coal | 96 | 40 | not used | — | — | 5.0 | 14 | 7 | 15 | 36 | — |

TABLE 8-continued

| | | | | | | | | | | | | |
|---|---|---|---|---|---|---|---|---|---|---|---|---|
| Ex. 25 | e | | | | | | | | | | | |
| Ex. 62 | coal e | 96 | 40 | calcium chloride ($CaCl_2$) | 0.3 | before pulverization | 0.5 | 14 | 10 | 15 | 39 | 3 |
| Ex. 63 | coal e | 96 | 40 | calcium chloride ($CaCl_2$) | 0.3 | before pulverization | 1.0 | 16 | 13 | 17 | 46 | 10 |
| Ex. 64 | coal e | 96 | 40 | calcium chloride ($CaCl_2$) | 0.3 | before pulverization | 1.5 | 17 | 14 | 17 | 48 | 12 |
| Ex. 65 | coal e | 96 | 40 | calcium chloride ($CaCl_2$) | 0.3 | before pulverization | 3.0 | 17 | 14 | 18 | 49 | 13 |
| Ex. 66 | coal e | 96 | 40 | calcium chloride ($CaCl_2$) | 0.3 | before pulverization | 5.0 | 18 | 14 | 18 | 50 | 14 |
| Ex. 67 | coal e | 96 | 40 | calcium chloride ($CaCl_2$) | 0.3 | before pulverization | 10.0 | 18 | 16 | 18 | 52 | 16 |
| Ex. 68 | coal e | 96 | 40 | calcium chloride ($CaCl_2$) | 0.3 | before pulverization | 30.0 | 18 | 17 | 18 | 53 | 17 |
| Comp. Ex. 26 | coal e | 96 | 10 | not used | — | — | 5.0 | 15 | 13 | 17 | 45 | — |
| Ex. 69 | coal e | 96 | 10 | calcium chloride ($CaCl_2$) | 0.3 | before pulverization | 0.5 | 16 | 15 | 17 | 48 | 3 |
| Ex. 70 | coal e | 96 | 10 | calcium chloride ($CaCl_2$) | 0.3 | before pulverization | 1.0 | 17 | 15 | 18 | 50 | 5 |
| Ex. 71 | coal e | 96 | 10 | calcium chloride ($CaCl_2$) | 0.3 | before pulverization | 1.5 | 17 | 18 | 18 | 53 | 8 |
| Ex. 72 | coal e | 96 | 10 | calcium chloride ($CaCl_2$) | 0.3 | before pulverization | 3.0 | 18 | 17 | 19 | 54 | 9 |
| Ex. 73 | coal e | 96 | 10 | calcium chloride ($CaCl_2$) | 0.3 | before pulverization | 5.0 | 18 | 18 | 19 | 55 | 10 |
| Ex. 74 | coal e | 96 | 10 | calcium chloride ($CaCl_2$) | 0.3 | before pulverization | 10.0 | 18 | 18 | 19 | 55 | 10 |
| Ex. 75 | coal e | 96 | 10 | calcium chloride ($CaCl_2$) | 0.3 | before pulverization | 30.0 | 19 | 17 | 19 | 55 | 10 |

| | Pressure drop ($mmH_2O/m$) | | Qty. of triboelectrifn. ($\mu c/g$) | |
|---|---|---|---|---|
| | pressure drop | decrease | qty. of triboelectrifn. | decrease |
| Comp. Ex. 25 | 20.0 | — | 3.94 | — |
| Ex. 62 | 17.5 | 2.5 | 3.14 | 0.80 |
| Ex. 63 | 10.9 | 9.1 | 2.80 | 1.14 |
| Ex. 64 | 10.3 | 9.7 | 0.83 | 3.11 |
| Ex. 65 | 9.6 | 10.4 | 0.22 | 3.72 |
| Ex. 66 | 9.0 | 11.0 | 0.07 | 3.87 |
| Ex. 67 | 8.5 | 11.5 | 0.09 | 3.85 |
| Ex. 68 | 8.3 | 11.7 | 0.05 | 3.89 |
| Comp. Ex. 26 | 13.0 | — | 1.35 | — |
| Ex. 69 | 8.5 | 4.5 | 0.67 | 0.68 |
| Ex. 70 | 8.4 | 4.5 | 0.31 | 1.04 |
| Ex. 71 | 8.0 | 5.0 | 0.12 | 1.23 |
| Ex. 72 | 8.0 | 5.0 | 0.11 | 1.24 |
| Ex. 73 | 8.0 | 5.0 | 0.08 | 1.27 |
| Ex. 74 | 8.0 | 5.0 | 0.07 | 1.28 |
| Ex. 75 | 8.0 | 5.0 | 0.06 | 1.29 |

TABLE 9

| | Pulverized coal | | | Transportability improver | | | | Fluidity | | | | |
|---|---|---|---|---|---|---|---|---|---|---|---|---|
| | raw coal | | 106 $\mu$m or | | | | water concn. at | | | | | |
| | kind | HGI | below (%) | compd. | concn. (%) | timing of addition | pulverization (%) | angle of respose | compress-ibility | spatula angle | fluidity index | increase |
| Comp. Ex. 27 | coal e | 96 | 95 | not used | — | — | 5.0 | 12 | 7 | 15 | 34 | — |
| Comp. Ex. 28 | coal e | 96 | 70 | not used | — | — | 5.0 | 14 | 6 | 15 | 35 | — |
| Comp. | coal | 96 | 40 | not used | — | — | 5.0 | 14 | 7 | 15 | 36 | — |

TABLE 9-continued

| | | | | | | | | | | | | |
|---|---|---|---|---|---|---|---|---|---|---|---|---|
| Ex. 29 | e | | | | | | | | | | | |
| Comp. Ex. 30 | coal e | 96 | 10 | not used | — | — | 5.0 | 15 | 13 | 17 | 45 | — |
| Ex. 76 | coal e | 96 | 95 | calcium chloride ($CaCl_2$) | 0.3 | after pulverization | 5.0 | 13 | 8 | 16 | 37 | 3 |
| Ex. 77 | coal e | 96 | 70 | calcium chloride ($CaCl_2$) | 0.3 | after pulverization | 5.0 | 15 | 7 | 16 | 38 | 3 |
| Ex. 78 | coal e | 96 | 40 | calcium chloride ($CaCl_2$) | 0.3 | after pulverization | 5.0 | 15 | 8 | 16 | 39 | 3 |
| Ex. 79 | coal e | 96 | 10 | calcium chloride ($CaCl_2$) | 0.3 | after pulverization | 5.0 | 18 | 13 | 17 | 48 | 3 |

| | Pressure drop ($mmH_2O/m$) | | Qty. of triboelectrifn. ($\mu c/g$) | |
|---|---|---|---|---|
| | pressure drop | decrease | qty. of triboelectrifn. | decrease |
| Comp. Ex. 27 | 29.0 | — | 4.27 | — |
| Comp. Ex. 28 | 22.0 | — | 3.95 | — |
| Comp. Ex. 29 | 20.5 | — | 2.45 | — |
| Comp. Ex. 30 | 13.0 | — | 1.35 | — |
| Ex. 76 | 22.0 | 7.0 | 3.15 | 1.12 |
| Ex. 77 | 18.0 | 4.0 | 2.90 | 1.05 |
| Ex. 78 | 17.0 | 3.5 | 1.60 | 0.85 |
| Ex. 79 | 9.5 | 3.5 | 0.67 | 0.68 |

TABLE 10

| | Pulverized coal | | | Transportability improver | | | water concn. at | Fluidity | | | | |
|---|---|---|---|---|---|---|---|---|---|---|---|---|
| | raw coal | | 106 μm or | | concn. | timing of | pulverization | angle of | compress- | spatula | fluidity | |
| | kind | HGI | below (%) | compd. | (%) | addition | (%) | respose | ibility | angle | index | increase |
| Ex. 80 | coal e | 96 | 95 | $Al(NO_3)_3$ | 0.3 | before pulverization | 5.0 | 17 | 12 | 17 | 46 | 12 |
| Ex. 81 | coal e | 96 | 95 | $Al_2(SO_4)_3$ | 0.3 | before pulverization | 5.0 | 17 | 12 | 17 | 46 | 12 |
| Ex. 82 | coal e | 96 | 95 | $Al(ClO_4)_3$ | 0.3 | before pulverization | 5.0 | 17 | 12 | 17 | 46 | 12 |
| Ex. 83 | coal e | 96 | 95 | $BaBr_2$ | 0.3 | before pulverization | 5.0 | 17 | 12 | 17 | 46 | 12 |
| Ex. 84 | coal e | 96 | 95 | $BaCl_2$ | 0.3 | before pulverization | 5.0 | 18 | 13 | 18 | 49 | 15 |
| Ex. 85 | coal e | 96 | 95 | $Ba(ClO_3)_2$ | 0.3 | before pulverization | 5.0 | 17 | 12 | 17 | 46 | 12 |
| Ex. 86 | coal e | 96 | 95 | $Ba(ClO_4)_2$ | 0.3 | before pulverization | 5.0 | 17 | 12 | 17 | 46 | 12 |
| Ex. 87 | coal e | 96 | 95 | $BaI_2$ | 0.3 | before pulverization | 5.0 | 17 | 12 | 17 | 46 | 12 |
| Ex. 88 | coal e | 96 | 95 | $Ba(NO_2)_2$ | 0.3 | before pulverization | 5.0 | 17 | 12 | 17 | 46 | 12 |
| Ex. 89 | coal e | 96 | 95 | $Ba(SH)_2$ | 0.3 | before pulverization | 5.0 | 17 | 12 | 17 | 46 | 12 |
| Ex. 90 | coal e | 96 | 95 | $BaS_2O_6$ | 0.3 | before pulverization | 5.0 | 17 | 12 | 17 | 46 | 12 |
| Ex. 91 | coal e | 96 | 95 | $Ba(SO_3NH)_2$ | 0.3 | before pulverization | 5.0 | 17 | 12 | 17 | 46 | 12 |
| Ex. 92 | coal e | 96 | 95 | $BaS_2O_8$ | 0.3 | before pulverization | 5.0 | 17 | 12 | 17 | 46 | 12 |
| Ex. 93 | coal e | 96 | 95 | $BeCl_2$ | 0.3 | before pulverization | 5.0 | 17 | 12 | 17 | 46 | 12 |
| Ex. 94 | coal e | 96 | 95 | $Be(ClO_4)_2$ | 0.3 | before pulverization | 5.0 | 17 | 12 | 17 | 46 | 12 |

| | Pressure drop ($mmH_2O/m$) | | Qty. of triboelectrifn. (μc/g) | |
|---|---|---|---|---|
| | pressure drop | decrease | qty. of triboelectrifn. | decrease |
| Ex. 80 | 8.9 | 20.1 | 0.18 | 4.09 |
| Ex. 81 | 8.8 | 20.2 | 0.15 | 4.12 |
| Ex. 82 | 9.0 | 20.0 | 0.16 | 4.11 |
| Ex. 83 | 9.2 | 19.8 | 0.17 | 4.10 |
| Ex. 84 | 7.8 | 21.2 | 0.08 | 4.19 |
| Ex. 85 | 8.7 | 20.3 | 0.18 | 4.09 |
| Ex. 86 | 9.0 | 20.0 | 0.17 | 4.10 |
| Ex. 87 | 8.9 | 20.1 | 0.16 | 4.11 |
| Ex. 88 | 8.8 | 20.2 | 0.18 | 4.09 |
| Ex. 89 | 8.7 | 20.3 | 0.17 | 4.10 |
| Ex. 90 | 9.3 | 19.7 | 0.17 | 4.10 |
| Ex. 91 | 9.2 | 19.8 | 0.17 | 4.10 |
| Ex. 92 | 8.9 | 20.1 | 0.19 | 4.08 |
| Ex. 93 | 9.0 | 20.0 | 0.18 | 4.09 |
| Ex. 94 | 9.1 | 19.9 | 0.17 | 4.10 |

TABLE 11

| | Pulverized coal | | | Transportability improver | | | water concn. at | Fluidity | | | | |
|---|---|---|---|---|---|---|---|---|---|---|---|---|
| | raw coal | | 106 μm or | | concn. | timing of | pulverization | angle of | compress- | spatula | fluidity | |
| | kind | HGI | below (%) | compd. | (%) | addition | (%) | respose | ibility | angle | index | increase |
| Ex. 95 | coal e | 96 | 95 | $Be(NO_3)_2$ | 0.3 | before pulverization | 5.0 | 17 | 12 | 17 | 46 | 12 |
| Ex. 96 | coal e | 96 | 95 | $BeSO_4$ | 0.3 | before pulverization | 5.0 | 17 | 12 | 17 | 46 | 12 |
| Ex. 97 | coal e | 96 | 95 | $BeF_2$ | 0.3 | before pulverization | 5.0 | 17 | 12 | 17 | 46 | 12 |

TABLE 11-continued

| | | | | | | | | | | | | |
|---|---|---|---|---|---|---|---|---|---|---|---|---|
| Ex. 98 | coal e | 96 | 95 | $CaBr_2$ | 0.3 | before pulverization | 5.0 | 17 | 12 | 17 | 46 | 12 |
| Ex. 99 | coal e | 96 | 95 | $CaCl_2$ | 0.3 | before pulverization | 5.0 | 18 | 13 | 18 | 49 | 15 |
| Ex. 100 | coal e | 96 | 95 | $Ca(ClO_3)_2$ | 0.3 | before pulverization | 5.0 | 17 | 12 | 17 | 46 | 12 |
| Ex. 101 | coal e | 96 | 95 | $Ca(ClO_4)_2$ | 0.3 | before pulverization | 5.0 | 17 | 12 | 17 | 46 | 12 |
| Ex. 102 | coal e | 96 | 95 | $CaCr_2O_7$ | 0.3 | before pulverization | 5.0 | 17 | 12 | 17 | 46 | 12 |
| Ex. 103 | coal e | 96 | 95 | $Ca_2Fe(CN)_6$ | 0.3 | before pulverization | 4.0 | 17 | 12 | 17 | 46 | 12 |
| Ex. 104 | coal e | 96 | 95 | $CaI_2$ | 0.3 | before pulverization | 5.0 | 17 | 12 | 17 | 46 | 12 |
| Ex. 105 | coal e | 96 | 95 | $Ca(NO_2)_2$ | 0.3 | before pulverization | 5.0 | 18 | 13 | 18 | 49 | 15 |
| Ex. 106 | coal e | 96 | 95 | $Ca(NO_3)_2$ | 0.3 | before pulverization | 5.0 | 18 | 13 | 18 | 49 | 15 |
| Ex. 107 | coal e | 96 | 95 | $CaS_2O_3$ | 0.3 | before pulverization | 5.0 | 17 | 12 | 17 | 46 | 12 |
| Ex. 108 | coal e | 96 | 95 | $Ca(SO_3NH_2)_2$ | 0.3 | before pulverization | 5.0 | 17 | 12 | 17 | 46 | 12 |
| Ex. 109 | coal e | 96 | 95 | $Ca(ClO)_2$ | 0.3 | before pulverization | 5.0 | 18 | 13 | 18 | 49 | 15 |

| | Pressure drop ($mmH_2O/m$) | | Qty. of triboelectrifn. ($\mu c/g$) | |
|---|---|---|---|---|
| | pressure drop | decrease | qty. of triboelectrifn. | decrease |
| Ex. 95 | 9.2 | 19.8 | 0.18 | 4.09 |
| Ex. 96 | 8.8 | 20.2 | 0.18 | 4.09 |
| Ex. 97 | 8.7 | 20.3 | 0.17 | 4.10 |
| Ex. 98 | 9.2 | 19.8 | 0.19 | 4.08 |
| Ex. 99 | 7.8 | 21.2 | 0.08 | 4.19 |
| Ex. 100 | 9.1 | 19.9 | 0.16 | 4.11 |
| Ex. 101 | 9.1 | 19.9 | 0.18 | 4.09 |
| Ex. 102 | 8.9 | 20.1 | 0.17 | 4.10 |
| Ex. 103 | 9.2 | 19.8 | 0.17 | 4.10 |
| Ex. 104 | 9.2 | 19.8 | 0.19 | 4.08 |
| Ex. 105 | 7.8 | 21.2 | 0.08 | 4.19 |
| Ex. 106 | 7.8 | 21.2 | 0.08 | 4.19 |
| Ex. 107 | 9.2 | 19.8 | 0.16 | 4.11 |
| Ex. 108 | 8.8 | 20.2 | 0.19 | 4.08 |
| Ex. 109 | 7.8 | 21.2 | 0.08 | 4.19 |

TABLE 12

| | Pulverized coal | | | Transportability improver | | | | | Fluidity | | | | |
|---|---|---|---|---|---|---|---|---|---|---|---|---|---|
| | raw coal | | 106 $\mu$m or | | | | water concn. at | | | | | | |
| | kind | HGI | below (%) | compd. | concn. (%) | timing of addition | pulverization (%) | angle of respose | compress-ibility | spatula angle | fluidity index | increase |
| Ex. 110 | coal e | 96 | 95 | $CaSiF_6$ | 0.3 | before pulverization | 5.0 | 17 | 12 | 17 | 46 | 12 |
| Ex. 111 | coal e | 96 | 95 | $Cr(ClO_4)_2$ | 0.3 | before pulverization | 5.0 | 17 | 12 | 17 | 46 | 12 |
| Ex. 112 | coal e | 96 | 95 | $Cr(NO_3)_3$ | 0.3 | before pulverization | 5.0 | 17 | 12 | 17 | 46 | 12 |
| Ex. 113 | coal e | 96 | 95 | $CrCl_3$ | 0.3 | before pulverization | 5.0 | 17 | 12 | 17 | 46 | 12 |
| Ex. 114 | coal e | 96 | 95 | $CuBr_2$ | 0.3 | before pulverization | 5.0 | 17 | 12 | 17 | 46 | 12 |
| Ex. 115 | coal e | 96 | 95 | $CrCl_2$ | 0.3 | before pulverization | 5.0 | 17 | 12 | 17 | 46 | 12 |
| Ex. 116 | coal e | 96 | 95 | $Cu(ClO_3)_2$ | 0.3 | before pulverization | 5.0 | 17 | 12 | 17 | 46 | 12 |
| Ex. 117 | coal e | 96 | 95 | $Cu(NO_3)_2$ | 0.3 | before pulverization | 5.0 | 17 | 12 | 17 | 46 | 12 |
| Ex. 118 | coal e | 96 | 95 | $CuSO_4$ | 0.3 | before pulverization | 5.0 | 17 | 12 | 17 | 46 | 12 |
| Ex. 119 | coal e | 96 | 95 | $CuSiF_6$ | 0.3 | before pulverization | 5.0 | 17 | 12 | 17 | 46 | 12 |

TABLE 12-continued

| | | | | | | | | | | | | |
|---|---|---|---|---|---|---|---|---|---|---|---|---|
| Ex. 120 | coal e | 96 | 95 | $Cu(ClO_4)_2$ | 0.3 | before pulverization | 5.0 | 17 | 12 | 17 | 46 | 12 |
| Ex. 121 | coal e | 96 | 95 | $CuS_2O_6$ | 0.3 | before pulverization | 5.0 | 17 | 12 | 17 | 46 | 12 |
| Ex. 122 | coal e | 96 | 95 | $Cu(SO_3NH_2)_2$ | 0.3 | before pulverization | 5.0 | 17 | 12 | 17 | 46 | 12 |
| Ex. 123 | coal e | 96 | 95 | $FeCl_2$ | 0.3 | before pulverization | 5.0 | 17 | 12 | 17 | 46 | 12 |
| Ex. 124 | coal e | 96 | 95 | $FeCl_3$ | 0.3 | before pulverization | 5.0 | 17 | 12 | 17 | 46 | 12 |

| | Pressure drop ($mmH_2O/m$) | | Qty. of triboelectrifn. ($\mu c/g$) | |
|---|---|---|---|---|
| | pressure drop | decrease | qty. of triboelectrifn. | decrease |
| Ex. 110 | 9.2 | 19.8 | 0.16 | 4.11 |
| Ex. 111 | 8.8 | 20.2 | 0.18 | 4.09 |
| Ex. 112 | 9.2 | 19.8 | 0.18 | 4.09 |
| Ex. 113 | 8.8 | 20.2 | 0.15 | 4.12 |
| Ex. 114 | 8.8 | 20.2 | 0.16 | 4.11 |
| Ex. 115 | 9.0 | 20.0 | 0.18 | 4.09 |
| Ex. 116 | 8.9 | 20.1 | 0.16 | 4.11 |
| Ex. 117 | 9.1 | 19.9 | 0.18 | 4.09 |
| Ex. 118 | 9.2 | 19.8 | 0.16 | 4.11 |
| Ex. 119 | 9.0 | 20.0 | 0.18 | 4.09 |
| Ex. 120 | 9.0 | 20.0 | 0.19 | 4.08 |
| Ex. 121 | 9.2 | 19.8 | 0.17 | 4.10 |
| Ex. 122 | 8.7 | 20.3 | 0.17 | 4.10 |
| Ex. 123 | 8.9 | 20.1 | 0.16 | 4.11 |
| Ex. 124 | 9.3 | 19.7 | 0.18 | 4.09 |

TABLE 13

| | Pulverized coal | | | Transportability improver | | | | Fluidity | | | | |
|---|---|---|---|---|---|---|---|---|---|---|---|---|
| | raw coal | | 106 $\mu m$ or | | | | water concn. at | | | | | |
| | kind | HGI | below (%) | compd. | concn. (%) | timing of addition | pulverization (%) | angle of respose | compress-ibility | spatula angle | fluidity index | increase |
| Ex. 125 | coal e | 96 | 95 | $Fe(ClO_4)_2$ | 0.3 | before pulverization | 5.0 | 17 | 12 | 17 | 46 | 12 |
| Ex. 126 | coal e | 96 | 95 | $Fe(ClO_4)_3$ | 0.3 | before pulverization | 5.0 | 17 | 12 | 17 | 46 | 12 |
| Ex. 127 | coal e | 96 | 95 | $Fe(NO_3)_2$ | 0.3 | before pulverization | 5.0 | 17 | 12 | 17 | 46 | 12 |
| Ex. 128 | coal e | 96 | 95 | $Fe(NO_3)_3$ | 0.3 | before pulverization | 5.0 | 17 | 12 | 17 | 46 | 12 |
| Ex. 129 | coal e | 96 | 95 | $FeSO_4$ | 0.3 | before pulverization | 5.0 | 17 | 12 | 17 | 46 | 12 |
| Ex. 130 | coal e | 96 | 95 | $FeSiF_6$ | 0.3 | before pulverization | 5.0 | 17 | 12 | 17 | 46 | 12 |
| Ex. 131 | coal e | 96 | 95 | $K_2BeF_4$ | 0.3 | before pulverization | 5.0 | 17 | 12 | 17 | 46 | 12 |
| Ex. 132 | coal e | 96 | 95 | KBr | 0.3 | before pulverization | 5.0 | 17 | 12 | 17 | 46 | 12 |
| Ex. 133 | coal e | 96 | 95 | $K_2CO_3$ | 0.3 | before pulverization | 5.0 | 18 | 13 | 18 | 49 | 15 |
| Ex. 134 | coal e | 96 | 95 | $K_2Cd(SO_3)_2$ | 0.3 | before pulverization | 5.0 | 17 | 12 | 17 | 46 | 12 |
| Ex. 135 | coal e | 96 | 95 | KCl | 0.3 | before pulverization | 5.0 | 18 | 13 | 18 | 49 | 15 |
| Ex. 136 | coal e | 96 | 95 | $K_2CrO_4$ | 0.3 | before pulverization | 5.0 | 17 | 12 | 17 | 46 | 12 |
| Ex. 137 | coal e | 96 | 95 | KF | 0.3 | before pulverization | 5.0 | 17 | 12 | 17 | 46 | 12 |
| Ex. 138 | coal e | 96 | 95 | $K_3Fe(CN)_6$ | 0.3 | before pulverization | 5.0 | 17 | 12 | 17 | 46 | 12 |
| Ex. 139 | coal e | 96 | 95 | $K_4Fe(CN)_6$ | 0.3 | before pulverization | 5.0 | 17 | 12 | 17 | 46 | 12 |

TABLE 13-continued

| | Pressure drop ($mmH_2O/m$) | | Qty. of triboelectrifn. ($\mu c/g$) | |
|---|---|---|---|---|
| | pressure drop | decrease | qty. of triboelectrifn. | decrease |
| Ex. 125 | 8.9 | 20.1 | 0.18 | 4.09 |
| Ex. 126 | 9.3 | 19.7 | 0.17 | 4.10 |
| Ex. 127 | 9.2 | 19.8 | 0.17 | 4.10 |
| Ex. 128 | 8.8 | 20.2 | 0.16 | 4.11 |
| Ex. 129 | 8.9 | 20.1 | 0.16 | 4.11 |
| Ex. 130 | 8.9 | 20.1 | 0.17 | 4.10 |
| Ex. 131 | 8.7 | 20.3 | 0.15 | 4.12 |
| Ex. 132 | 9.1 | 19.9 | 0.17 | 4.10 |
| Ex. 133 | 7.8 | 21.2 | 0.08 | 4.19 |
| Ex. 134 | 9.2 | 19.8 | 0.16 | 4.11 |
| Ex. 135 | 7.8 | 21.2 | 0.08 | 4.19 |
| Ex. 136 | 8.7 | 20.3 | 0.19 | 4.08 |
| Ex. 137 | 9.1 | 19.9 | 0.16 | 4.11 |
| Ex. 138 | 8.9 | 20.1 | 0.16 | 4.11 |
| Ex. 139 | 9.2 | 19.8 | 0.19 | 4.08 |

TABLE 14

| | Pulverized coal | | | Transportability improver | | | | Fluidity | | | | |
|---|---|---|---|---|---|---|---|---|---|---|---|---|
| | raw coal | | 106 $\mu m$ or | | | | water concn. at | | | | | |
| | kind | HGI | below (%) | compd. | concn. (%) | timing of addition | pulverization (%) | angle of respose | compress-ibility | spatula angle | fluidity index | increase |
| Ex. 140 | coal e | 96 | 95 | $K_2Fe(SO_4)_2$ | 0.3 | before pulverization | 5.0 | 17 | 12 | 17 | 46 | 12 |
| Ex. 141 | coal e | 96 | 95 | $KHCO_3$ | 0.3 | before pulverization | 5.0 | 17 | 12 | 17 | 46 | 12 |
| Ex. 142 | coal e | 96 | 95 | $KHF_2$ | 0.3 | before pulverization | 5.0 | 17 | 12 | 17 | 46 | 12 |
| Ex. 143 | coal e | 96 | 95 | $KH_2PO_4$ | 0.3 | before pulverization | 5.0 | 17 | 12 | 17 | 46 | 12 |
| Ex. 144 | coal e | 96 | 95 | $KHSO_4$ | 0.3 | before pulverization | 5.0 | 17 | 12 | 17 | 46 | 12 |
| Ex. 145 | coal e | 96 | 95 | KI | 0.3 | before pulverization | 5.0 | 17 | 12 | 17 | 46 | 12 |
| Ex. 146 | coal e | 96 | 95 | $KNO_3$ | 0.3 | before pulverization | 5.0 | 17 | 12 | 17 | 46 | 12 |
| Ex. 147 | coal e | 96 | 95 | KOH | 0.3 | before pulverization | 5.0 | 17 | 12 | 17 | 46 | 12 |
| Ex. 148 | coal e | 96 | 95 | $K_3PO_4$ | 0.3 | before pulverization | 5.0 | 17 | 12 | 17 | 46 | 12 |
| Ex. 149 | coal e | 96 | 95 | $K_4P_2O_7$ | 0.3 | before pulverization | 5.0 | 17 | 12 | 17 | 46 | 12 |
| Ex. 150 | coal e | 96 | 95 | $K_2SO_3$ | 0.3 | before pulverization | 5.0 | 17 | 12 | 17 | 46 | 12 |
| Ex. 151 | coal e | 96 | 95 | $K_2S_2O_3$ | 0.3 | before pulverization | 5.0 | 17 | 12 | 17 | 46 | 12 |
| Ex. 152 | coal e | 96 | 95 | $K_2S_2O_5$ | 0.3 | before pulverization | 5.0 | 17 | 12 | 17 | 46 | 12 |
| Ex. 153 | coal e | 96 | 95 | $K_2S_2O_8$ | 00.3 | before pulverization | 5.0 | 17 | 12 | 17 | 46 | 12 |
| Ex. 154 | coal e | 96 | 95 | $KSO_3NH_3$ | 0.3 | before pulverization | 5.0 | 17 | 12 | 17 | 46 | 12 |

| | Pressure drop ($mmH_2O/m$) | | Qty. of triboelectrifn. ($\mu c/g$) | |
|---|---|---|---|---|
| | pressure drop | decrease | qty. of triboelectrifn. | decrease |
| Ex. 140 | 8.9 | 20.1 | 0.15 | 4.12 |
| Ex. 141 | 8.8 | 20.2 | 0.16 | 4.11 |
| Ex. 142 | 9.0 | 20.0 | 0.18 | 4.09 |
| Ex. 143 | 8.8 | 20.2 | 0.16 | 4.11 |
| Ex. 144 | 8.9 | 20.1 | 0.17 | 4.10 |
| Ex. 145 | 8.7 | 20.3 | 0.18 | 4.09 |
| Ex. 146 | 9.2 | 19.8 | 0.18 | 4.09 |
| Ex. 147 | 9.3 | 19.7 | 0.19 | 4.08 |
| Ex. 148 | 9.0 | 20.0 | 0.15 | 4.12 |

TABLE 14-continued

| | Pressure drop (mmH$_2$O/m) | | Qty. of triboelectrifn. ($\mu$c/g) | |
|---|---|---|---|---|
| | pressure drop | decrease | qty. of triboelectrifn. | decrease |
| Ex. 149 | 9.2 | 19.8 | 0.16 | 4.11 |
| Ex. 150 | 8.9 | 20.1 | 0.15 | 4.12 |
| Ex. 151 | 9.2 | 19.8 | 0.16 | 4.11 |
| Ex. 152 | 9.2 | 19.8 | 0.15 | 4.12 |
| Ex. 153 | 9.2 | 19.8 | 0.18 | 4.09 |
| Ex. 154 | 8.8 | 20.2 | 0.19 | 4.08 |

TABLE 15

| | Pulverized coal | | | Transportability improver | | | | Fluidity | | | | |
|---|---|---|---|---|---|---|---|---|---|---|---|---|
| | raw coal | | 106 $\mu$m or | | concn. | timing of | water concn. at pulverization | angle of | compress- | spatula | fluidity | |
| | kind | HGI | below (%) | compd. | (%) | addition | (%) | respose | ibility | angle | index | increase |
| Ex. 155 | coal e | 96 | 95 | KCN | 0.3 | before pulverization | 5.0 | 17 | 12 | 17 | 46 | 12 |
| Ex. 156 | coal e | 96 | 95 | $KPH_2O_2$ | 0.3 | before pulverization | 5.0 | 17 | 12 | 17 | 46 | 12 |
| Ex. 157 | coal e | 96 | 95 | $KHPHO_3$ | 0.3 | before pulverization | 5.0 | 17 | 12 | 17 | 46 | 12 |
| Ex. 158 | coal e | 96 | 95 | $KH_3P_2O_6$ | 0.3 | before pulverization | 5.0 | 17 | 12 | 17 | 46 | 12 |
| Ex. 159 | coal e | 96 | 95 | $KH_5P_2O_8$ | 0.3 | before pulverization | 5.0 | 17 | 12 | 17 | 46 | 12 |
| Ex. 160 | coal e | 96 | 95 | $K_2H_2P_2O_6$ | 0.3 | before pulverization | 5.0 | 17 | 12 | 17 | 46 | 12 |
| Ex. 161 | coal e | 96 | 95 | $K_3HPO_2O_6$ | 0.3 | before pulverization | 5.0 | 17 | 12 | 17 | 46 | 12 |
| Ex. 162 | coal e | 96 | 95 | $K_3H_5(P_2O_6)_2$ | 0.3 | before pulverization | 5.0 | 17 | 12 | 17 | 46 | 12 |
| Ex. 163 | coal e | 96 | 95 | $K_2S_3O_5$ | 0.3 | before pulverization | 5.0 | 17 | 12 | 17 | 46 | 12 |
| Ex. 164 | coal e | 96 | 95 | $K_2S_3O_6$ | 0.3 | before pulverization | 5.0 | 17 | 12 | 17 | 46 | 12 |
| Ex. 165 | coal e | 96 | 95 | $K_2S_6O_6$ | 0.3 | before pulverization | 5.0 | 17 | 12 | 17 | 46 | 12 |
| Ex. 166 | coal e | 96 | 95 | $MgBr_2$ | 0.3 | before pulverization | 5.0 | 17 | 12 | 17 | 46 | 12 |
| Ex. 167 | coal e | 96 | 95 | $Mg(BrO_3)_3$ | 0.3 | before pulverization | 5.0 | 17 | 12 | 17 | 46 | 12 |
| Ex. 168 | coal e | 96 | 95 | $MgCl_2$ | 0.3 | before pulverization | 5.0 | 18 | 13 | 18 | 49 | 15 |
| Ex. 169 | coal e | 96 | 95 | $Mg(ClO_3)_2$ | 0.3 | before pulverization | 5.0 | 17 | 12 | 17 | 46 | 12 |

| | Pressure drop (mmH$_2$O/m) | | Qty. of triboelectrifn. ($\mu$c/g) | |
|---|---|---|---|---|
| | pressure drop | decrease | qty. of triboelectrifn. | decrease |
| Ex. 155 | 8.9 | 20.1 | 0.18 | 4.09 |
| Ex. 156 | 9.1 | 19.9 | 0.19 | 4.08 |
| Ex. 157 | 9.2 | 19.8 | 0.15 | 4.12 |
| Ex. 158 | 8.7 | 20.3 | 0.17 | 4.10 |
| Ex. 159 | 9.2 | 19.8 | 0.17 | 4.10 |
| Ex. 160 | 8.7 | 20.3 | 0.18 | 4.09 |
| Ex. 161 | 8.7 | 20.3 | 0.16 | 4.11 |
| Ex. 162 | 8.9 | 20.1 | 0.17 | 4.10 |
| Ex. 163 | 9.3 | 19.7 | 0.19 | 4.08 |
| Ex. 164 | 8.9 | 20.1 | 0.15 | 4.12 |
| Ex. 165 | 9.2 | 19.8 | 0.15 | 4.12 |
| Ex. 166 | 9.2 | 19.8 | 0.18 | 4.09 |
| Ex. 167 | 8.9 | 20.1 | 0.18 | 4.09 |
| Ex. 168 | 7.8 | 21.2 | 0.08 | 4.19 |
| Ex. 169 | 8.9 | 20.1 | 0.18 | 4.09 |

TABLE 16

| | Pulverized coal | | | Transportability improver | | | water concn. at | Fluidity | | | | |
|---|---|---|---|---|---|---|---|---|---|---|---|---|
| | raw coal | | 106 μm or | | concn. | timing of | pulverization | angle of | compress- | spatula | fluidity | |
| | kind | HGI | below (%) | compd. | (%) | addition | (%) | respose | ibility | angle | index | increase |
| Ex. 170 | coal e | 96 | 95 | $Mg(ClO_4)_2$ | 0.3 | before pulverization | 5.0 | 17 | 12 | 17 | 46 | 12 |
| Ex. 171 | coal e | 96 | 95 | $MgCrO_4$ | 0.3 | before pulverization | 5.0 | 17 | 12 | 17 | 46 | 12 |
| Ex. 172 | coal e | 96 | 95 | $MgCr_2O_7$ | 0.3 | before pulverization | 5.0 | 17 | 12 | 17 | 46 | 12 |
| Ex. 173 | coal e | 96 | 95 | $MgI_2$ | 0.3 | before pulverization | 5.0 | 17 | 12 | 17 | 46 | 12 |
| Ex. 174 | coal e | 96 | 95 | $Mg(NO_2)_2$ | 0.3 | before pulverization | 5.0 | 17 | 12 | 17 | 46 | 12 |
| Ex. 175 | coal e | 96 | 95 | $Mg(NO_3)_2$ | 0.3 | before pulverization | 5.0 | 17 | 12 | 17 | 46 | 12 |
| Ex. 176 | coal e | 96 | 95 | $MgSO_4$ | 0.3 | before pulverization | 5.0 | 18 | 13 | 18 | 49 | 15 |
| Ex. 177 | coal e | 96 | 95 | $MgS_2O_3$ | 0.3 | before pulverization | 5.0 | 17 | 12 | 17 | 46 | 12 |
| Ex. 178 | coal e | 96 | 95 | $MgMoO_4$ | 0.3 | before pulverization | 5.0 | 17 | 12 | 17 | 46 | 12 |
| Ex. 179 | coal e | 96 | 95 | $MgS_2O_6$ | 0.3 | before pulverization | 5.0 | 17 | 12 | 17 | 46 | 12 |
| Ex. 180 | coal e | 96 | 95 | $Mg(SO_3NH_2)_2$ | 0.3 | before pulverization | 5.0 | 17 | 12 | 17 | 46 | 12 |
| Ex. 181 | coal e | 96 | 95 | $MgSiF_6$ | 0.3 | before pulverization | 5.0 | 17 | 12 | 17 | 46 | 12 |
| Ex. 182 | coal e | 96 | 95 | $MnBr_2$ | 0.3 | before pulverization | 5.0 | 17 | 12 | 17 | 46 | 12 |
| Ex. 183 | coal e | 96 | 95 | $MnCl_2$ | 0.3 | before pulverization | 5.0 | 17 | 12 | 17 | 46 | 12 |
| Ex. 184 | coal e | 96 | 95 | $Mn(NO_3)_2$ | 0.3 | before pulverization | 5.0 | 17 | 12 | 17 | 46 | 12 |

| | Pressure drop ($mmH_2O/m$) | | Qty. of triboelectrifn. (μc/g) | |
|---|---|---|---|---|
| | pressure drop | decrease | qty. of triboelectrifn. | decrease |
| Ex. 170 | 8.7 | 20.3 | 0.17 | 4.10 |
| Ex. 171 | 8.7 | 20.3 | 0.19 | 4.08 |
| Ex. 172 | 9.1 | 19.9 | 0.17 | 4.10 |
| Ex. 173 | 8.8 | 20.2 | 0.18 | 4.09 |
| Ex. 174 | 9.1 | 19.9 | 0.18 | 4.09 |
| Ex. 175 | 8.7 | 20.3 | 0.18 | 4.09 |
| Ex. 176 | 7.8 | 21.2 | 0.08 | 4.19 |
| Ex. 177 | 8.7 | 20.3 | 0.17 | 4.10 |
| Ex. 178 | 9.2 | 19.8 | 0.18 | 4.09 |
| Ex. 179 | 9.0 | 20.0 | 0.19 | 4.08 |
| Ex. 180 | 8.8 | 20.2 | 0.18 | 4.09 |
| Ex. 181 | 8.8 | 20.2 | 0.18 | 4.09 |
| Ex. 182 | 9.0 | 20.0 | 0.16 | 4.11 |
| Ex. 183 | 9.1 | 19.9 | 0.16 | 4.11 |
| Ex. 184 | 9.0 | 20.0 | 0.16 | 4.11 |

TABLE 17

| | Pulverized coal | | | Transportability improver | | | water concn. at | Fluidity | | | | |
|---|---|---|---|---|---|---|---|---|---|---|---|---|
| | raw coal | | 106 μm or | | concn. | timing of | pulverization | angle of | compress- | spatula | fluidity | |
| | kind | HGI | below (%) | compd. | (%) | addition | (%) | respose | ibility | angle | index | increase |
| Ex. 185 | coal e | 96 | 95 | $MnSO_4$ | 0.3 | before pulverization | 5.0 | 17 | 12 | 17 | 46 | 12 |
| Ex. 186 | coal e | 96 | 95 | $Mn(ClO_4)_2$ | 0.3 | before pulverization | 5.0 | 17 | 12 | 17 | 46 | 12 |
| Ex. 187 | coal e | 96 | 95 | $NH_4CF_4$ | 0.3 | before pulverization | 5.0 | 18 | 13 | 18 | 49 | 15 |

TABLE 17-continued

| | | | | | | | | | | | | |
|---|---|---|---|---|---|---|---|---|---|---|---|---|
| Ex. 188 | coal e | 96 | 95 | $NH_4Br$ | 0.3 | before pulverization | 5.0 | 17 | 12 | 17 | 46 | 12 |
| Ex. 189 | coal e | 96 | 95 | $NH_4Cl$ | 0.3 | before pulverization | 5.0 | 18 | 13 | 18 | 49 | 15 |
| Ex. 190 | coal e | 96 | 95 | $NH_4ClO_4$ | 0.3 | before pulverization | 5.0 | 17 | 12 | 17 | 46 | 12 |
| Ex. 191 | coal e | 96 | 95 | $(NH_4)_2CrO_4$ | 0.3 | before pulverization | 5.0 | 17 | 12 | 17 | 46 | 12 |
| Ex. 192 | coal e | 96 | 95 | $(NH_4)_2Cr_2O_7$ | 0.3 | before pulverization | 5.0 | 17 | 12 | 17 | 46 | 12 |
| Ex. 193 | coal e | 96 | 95 | $(NH_4)_2Cu(SO_4)_2$ | 0.3 | before pulverization | 5.0 | 17 | 12 | 17 | 46 | 12 |
| Ex. 194 | coal e | 96 | 95 | $NH_4F$ | 0.3 | before pulverization | 5.0 | 17 | 12 | 17 | 46 | 12 |
| Ex. 195 | coal e | 96 | 95 | $(NH_4)_2Fe(SO_4)_2$ | 0.3 | before pulverization | 5.0 | 17 | 12 | 17 | 46 | 12 |
| Ex. 196 | coal e | 96 | 95 | $NH_4HCO_3$ | 0.3 | before pulverization | 5.0 | 17 | 12 | 17 | 46 | 12 |
| Ex. 197 | coal e | 96 | 95 | $NH_4HF_2$ | 0.3 | before pulverization | 5.0 | 17 | 12 | 17 | 46 | 12 |
| Ex. 198 | coal e | 96 | 95 | $NH_4H_2PO_4$ | 0.3 | before pulverization | 5.0 | 17 | 12 | 17 | 46 | 12 |
| Ex. 199 | coal e | 96 | 95 | $(NH_4)_2HPO_4$ | 0.3 | before pulverization | 5.0 | 17 | 12 | 17 | 46 | 12 |

| | Pressure drop ($mmH_2O/m$) | | Qty. of triboelectrifn. ($\mu c/g$) | |
|---|---|---|---|---|
| | pressure drop | decrease | qty. of triboelectrifn. | decrease |
| Ex. 185 | 8.9 | 20.1 | 0.18 | 4.09 |
| Ex. 186 | 9.0 | 20.0 | 0.19 | 4.08 |
| Ex. 187 | 7.8 | 21.2 | 0.08 | 4.19 |
| Ex. 188 | 9.2 | 19.8 | 0.18 | 4.09 |
| Ex. 189 | 7.8 | 21.2 | 0.08 | 4.19 |
| Ex. 190 | 9.2 | 19.8 | 0.15 | 4.12 |
| Ex. 191 | 9.1 | 19.9 | 0.17 | 4.10 |
| Ex. 192 | 9.0 | 20.0 | 0.17 | 4.10 |
| Ex. 193 | 9.2 | 19.8 | 0.18 | 4.09 |
| Ex. 194 | 8.9 | 20.1 | 0.15 | 4.12 |
| Ex. 195 | 8.8 | 20.2 | 0.18 | 4.09 |
| Ex. 196 | 9.0 | 20.0 | 0.16 | 4.11 |
| Ex. 197 | 9.0 | 20.0 | 0.15 | 4.12 |
| Ex. 198 | 8.9 | 20.1 | 0.16 | 4.11 |
| Ex. 199 | 9.2 | 19.8 | 0.18 | 4.09 |

TABLE 18

| | Pulverized coal | | | Transportability improver | | | | Fluidity | | | | |
|---|---|---|---|---|---|---|---|---|---|---|---|---|
| | raw coal | | 106 $\mu m$ or | | | | water concn. at | | | | | |
| | kind | HGI | below (%) | compd. | concn. (%) | timing of addition | pulverization (%) | angle of respose | compress-ibility | spatula angle | fluidity index | increase |
| Ex. 200 | coal e | 96 | 95 | $NH_4I$ | 0.3 | before pulverization | 5.0 | 17 | 12 | 17 | 46 | 12 |
| Ex. 201 | coal e | 96 | 95 | $NH_4NO_2$ | 0.3 | before pulverization | 5.0 | 17 | 12 | 17 | 46 | 12 |
| Ex. 202 | coal e | 96 | 95 | $NH_4NO_3$ | 0.3 | before pulverization | 5.0 | 17 | 12 | 17 | 46 | 12 |
| Ex. 203 | coal e | 96 | 95 | $(NH_4)_2Pb(SO_4)_2$ | 0.3 | before pulverization | 5.0 | 17 | 12 | 17 | 46 | 12 |
| Ex. 204 | coal e | 96 | 95 | $(NH_4)_2SO_3$ | 0.3 | before pulverization | 5.0 | 17 | 12 | 17 | 46 | 12 |
| Ex. 205 | coal e | 96 | 95 | $(NH_4)_2SO_4$ | 0.3 | before pulverization | 5.0 | 18 | 13 | 18 | 49 | 15 |
| Ex. 206 | coal e | 96 | 95 | $(NH_4)_2O_5$ | 0.3 | before pulverization | 5.0 | 17 | 12 | 17 | 46 | 12 |
| Ex. 207 | coal e | 96 | 95 | $(NH_4)_2S_2O_6$ | 0.3 | before pulverization | 5.0 | 17 | 12 | 17 | 46 | 12 |
| Ex. 208 | coal e | 96 | 95 | $(NH_4)_2S_2O_8$ | 0.3 | before pulverization | 5.0 | 17 | 12 | 17 | 46 | 12 |
| Ex. 209 | coal e | 96 | 95 | $NH_4SO_3NH_2$ | 0.3 | before pulverization | 5.0 | 17 | 12 | 17 | 46 | 12 |

TABLE 18-continued

| | | | | | | | | | | | | |
|---|---|---|---|---|---|---|---|---|---|---|---|---|
| Ex. 210 | coal e | 96 | 95 | $(NH_4)_2SiF_6$ | 0.3 | before pulverization | 5.0 | 17 | 12 | 17 | 46 | 12 |
| Ex. 211 | coal e | 96 | 95 | $NH_4B_3F_9$ | 0.3 | before pulverization | 5.0 | 17 | 12 | 17 | 46 | 12 |
| Ex. 212 | coal e | 96 | 95 | $(NH_4)_2CO_3$ | 0.3 | before pulverization | 5.0 | 17 | 12 | 17 | 46 | 12 |
| Ex. 213 | coal e | 96 | 95 | $NH_4CdCl_3$ | 0.3 | before pulverization | 5.0 | 17 | 12 | 17 | 46 | 12 |
| Ex. 214 | coal e | 96 | 95 | $(NH_4)_2CuCl_4$ | 0.3 | before pulverization | 5.0 | 17 | 12 | 17 | 46 | 12 |
| Ex. 215 | coal e | 96 | 95 | $(NH_4)_4Fe(CN)_6$ | 0.3 | before pulverization | 5.0 | 17 | 12 | 17 | 46 | 12 |

| | Pressure drop ($mmH_2O/m$) | | Qty. of triboelectrifn. ($\mu c/g$) | |
|---|---|---|---|---|
| | pressure drop | decrease | qty. of triboelectrifn. | decrease |
| Ex. 200 | 8.8 | 20.2 | 0.18 | 4.09 |
| Ex. 201 | 9.0 | 20.0 | 0.17 | 4.10 |
| Ex. 202 | 8.8 | 20.2 | 0.16 | 4.11 |
| Ex. 203 | 8.9 | 20.1 | 0.17 | 4.10 |
| Ex. 204 | 9.1 | 19.9 | 0.18 | 4.09 |
| Ex. 205 | 7.8 | 21.2 | 0.08 | 4.19 |
| Ex. 206 | 9.2 | 19.8 | 0.18 | 4.09 |
| Ex. 207 | 8.7 | 20.3 | 0.17 | 4.10 |
| Ex. 208 | 8.9 | 20.1 | 0.15 | 4.12 |
| Ex. 209 | 9.2 | 19.8 | 0.18 | 4.09 |
| Ex. 210 | 8.9 | 20.1 | 0.17 | 4.10 |
| Ex. 211 | 9.2 | 19.8 | 0.18 | 4.09 |
| Ex. 212 | 8.8 | 20.2 | 0.16 | 4.11 |
| Ex. 213 | 9.3 | 19.7 | 0.15 | 4.12 |
| Ex. 214 | 8.9 | 20.1 | 0.18 | 4.09 |
| Ex. 215 | 9.0 | 20.0 | 0.19 | 4.08 |

TABLE 19

| | Pulverized coal | | | Transportability improver | | | | Fluidity | | | | |
|---|---|---|---|---|---|---|---|---|---|---|---|---|
| | raw coal | | 106 $\mu m$ or | | | | water concn. at pulverization | | | | | |
| | kind | HGI | below (%) | compd. | concn. (%) | timing of addition | (%) | angle of respose | compress-ibility | spatula angle | fluidity index | increase |
| Ex. 216 | coal e | 96 | 95 | $(NH_4)_2Fe_2(SO_4)_2$ | 0.3 | before pulverization | 5.0 | 17 | 12 | 17 | 46 | 12 |
| Ex. 217 | coal e | 96 | 95 | $NH_4PH_2O_3$ | 0.3 | before pulverization | 5.0 | 17 | 12 | 17 | 46 | 12 |
| Ex. 218 | coal e | 96 | 95 | $(NH_4)_2H_2P_2O$ | 0.3 | before pulverization | 5.0 | 17 | 12 | 17 | 46 | 12 |
| Ex. 219 | coal e | 96 | 95 | $(NH_4)_3HP_2O_7$ | 0.3 | before pulverization | 5.0 | 17 | 12 | 17 | 46 | 12 |
| Ex. 220 | coal e | 96 | 95 | $(NH_4)_3PO_4$ | 0.3 | before pulverization | 5.0 | 17 | 12 | 17 | 46 | 12 |
| Ex. 221 | coal e | 96 | 95 | $(NH_4)_2S_3O_6$ | 0.3 | before pulverization | 5.0 | 17 | 12 | 17 | 46 | 12 |
| Ex. 222 | coal e | 96 | 95 | $(NH_4)_2S_4O_6$ | 0.3 | before pulverization | 5.0 | 17 | 12 | 17 | 46 | 12 |
| Ex. 223 | coal e | 96 | 95 | $NaAl(SO_4)_2$ | 0.3 | before pulverization | 5.0 | 17 | 12 | 17 | 46 | 12 |
| Ex. 224 | coal e | 96 | 95 | $NH_4OH$ | 0.3 | before pulverization | 5.0 | 18 | 13 | 18 | 49 | 15 |
| Ex. 225 | coal e | 96 | 95 | $NaBO_2$ | 0.3 | before pulverization | 5.0 | 17 | 12 | 17 | 46 | 12 |
| Ex. 226 | coal e | 96 | 95 | NaBr | 0.3 | before pulverization | 5.0 | 17 | 12 | 17 | 46 | 12 |
| Ex. 227 | coal e | 96 | 95 | $NaBrO_3$ | 0.3 | before pulverization | 5.0 | 17 | 12 | 17 | 46 | 12 |
| Ex. 228 | coal e | 96 | 95 | NaCN | 0.3 | before pulverization | 5.0 | 17 | 12 | 17 | 46 | 12 |
| Ex. 229 | coal e | 96 | 95 | $Na_2CO_3$ | 0.3 | before pulverization | 5.0 | 18 | 13 | 18 | 49 | 15 |
| Ex. 230 | coal e | 96 | 95 | NaCl | 0.3 | before pulverization | 5.0 | 18 | 13 | 18 | 49 | 15 |
| Ex. 231 | coal | 96 | 95 | NaClO | 0.3 | before | 5.0 | 17 | 12 | 17 | 46 | 12 |

TABLE 19-continued

| e | pulverization | | | |
|---|---|---|---|---|
| | Pressure drop ($mmH_2O/m$) | | Qty. of triboelectrifn. ($\mu c/g$) | |
| | pressure drop | decrease | qty. of triboelectrifn. | decrease |
| Ex. 216 | 9.2 | 19.8 | 0.18 | 4.09 |
| Ex. 217 | 9.2 | 19.8 | 0.17 | 4.10 |
| Ex. 218 | 9.1 | 19.9 | 0.15 | 4.12 |
| Ex. 219 | 8.8 | 20.2 | 0.16 | 4.11 |
| Ex. 220 | 9.1 | 19.9 | 0.17 | 4.10 |
| Ex. 221 | 9.2 | 19.8 | 0.16 | 4.11 |
| Ex. 222 | 8.8 | 20.2 | 0.19 | 4.08 |
| Ex. 223 | 8.8 | 20.2 | 0.16 | 4.11 |
| Ex. 224 | 7.8 | 21.2 | 0.08 | 4.19 |
| Ex. 225 | 9.2 | 19.8 | 0.17 | 4.10 |
| Ex. 226 | 8.9 | 20.1 | 0.17 | 4.10 |
| Ex. 227 | 8.7 | 20.3 | 0.18 | 4.09 |
| Ex. 228 | 9.1 | 19.9 | 0.16 | 4.11 |
| Ex. 229 | 7.8 | 21.2 | 0.08 | 4.19 |
| Ex. 230 | 7.8 | 21.2 | 0.08 | 4.19 |
| Ex. 231 | 8.9 | 20.1 | 0.17 | 4.10 |

TABLE 20

| | Pulverized coal | | | Transportability improver | | | | Fluidity | | | | |
|---|---|---|---|---|---|---|---|---|---|---|---|---|
| | raw coal | | 106 $\mu m$ or | | | | water concn. at | | | | | |
| | kind | HGI | below (%) | compd. | concn. (%) | timing of addition | pulverization (%) | angle of respose | compress-ibility | spatula angle | fluidity index | increase |
| Ex. 232 | coal e | 96 | 95 | $NaClO_2$ | 0.3 | before pulverization | 5.0 | 17 | 12 | 17 | 46 | 12 |
| Ex. 233 | coal e | 96 | 95 | $NaClO_3$ | 0.3 | before pulverization | 5.0 | 18 | 13 | 18 | 49 | 15 |
| Ex. 234 | coal e | 96 | 95 | $NaClO_4$ | 0.3 | before pulverization | 5.0 | 17 | 12 | 17 | 46 | 12 |
| Ex. 235 | coal e | 96 | 95 | $Na_4Fe(CN)$hd 6 | 0.3 | before pulverization | 5.0 | 17 | 12 | 17 | 46 | 12 |
| Ex. 236 | coal e | 96 | 95 | $NaH_2PO_4$ | 0.3 | before pulverization | 5.0 | 17 | 12 | 17 | 46 | 12 |
| Ex. 237 | coal e | 96 | 95 | NaI | 0.3 | before pulverization | 5.0 | 17 | 12 | 17 | 46 | 12 |
| Ex. 238 | coal e | 96 | 95 | $NaMnO_4$ | 0.3 | before pulverization | 5.0 | 17 | 12 | 17 | 46 | 12 |
| Ex. 239 | coal e | 96 | 95 | $NaNO_2$ | 0.3 | before pulverization | 5.0 | 18 | 13 | 18 | 49 | 15 |
| Ex. 240 | coal e | 96 | 95 | $NaNO_3$ | 0.3 | before pulverization | 5.0 | 18 | 13 | 18 | 49 | 15 |
| Ex. 241 | coal e | 96 | 95 | NaOH | 0.3 | before pulverization | 5.0 | 18 | 13 | 18 | 49 | 15 |
| Ex. 242 | coal e | 96 | 95 | $Na_2PHO_3$ | 0.3 | before pulverization | 5.0 | 17 | 12 | 17 | 46 | 12 |
| Ex. 243 | coal e | 96 | 95 | $Na_2SO_3$ | 0.3 | before pulverization | 5.0 | 17 | 12 | 17 | 46 | 12 |
| Ex. 244 | coal e | 96 | 95 | $Na_2S_2O_3$ | 0.3 | before pulverization | 5.0 | 18 | 13 | 18 | 49 | 15 |
| Ex. 245 | coal e | 96 | 95 | $NaS_2O_5$ | 0.3 | before pulverization | 5.0 | 18 | 13 | 18 | 49 | 15 |
| Ex. 246 | coal e | 96 | 95 | $NaSO_3NH_2$ | 0.3 | before pulverization | 5.0 | 17 | 12 | 17 | 46 | 12 |
| Ex. 247 | coal e | 96 | 95 | $Na_2Cr_4O_{13}$ | 0.3 | before pulverization | 5.0 | 17 | 12 | 17 | 46 | 12 |

| | Pressure drop ($mmH_2O/m$) | | Qty. of triboelectrifn. ($\mu c/g$) | |
|---|---|---|---|---|
| | pressure drop | decrease | qty. of triboelectrifn. | decrease |
| Ex. 232 | 9.1 | 19.9 | 0.17 | 4.10 |
| Ex. 233 | 7.8 | 21.2 | 0.08 | 4.19 |
| Ex. 234 | 8.8 | 20.2 | 0.16 | 4.11 |
| Ex. 235 | 9.0 | 20.0 | 0.16 | 4.11 |

TABLE 20-continued

| | | | | |
|---|---|---|---|---|
| Ex. 236 | 8.8 | 20.2 | 0.18 | 4.09 |
| Ex. 237 | 8.9 | 20.1 | 0.17 | 4.10 |
| Ex. 238 | 9.2 | 19.8 | 0.18 | 4.09 |
| Ex. 239 | 7.8 | 21.2 | 0.08 | 4.19 |
| Ex. 240 | 7.8 | 21.2 | 0.08 | 4.19 |
| Ex. 241 | 7.8 | 21.2 | 0.08 | 4.19 |
| Ex. 242 | 8.9 | 20.1 | 0.17 | 4.10 |
| Ex. 243 | 9.2 | 19.8 | 0.15 | 4.12 |
| Ex. 244 | 7.8 | 21.2 | 0.08 | 4.19 |
| Ex. 245 | 7.8 | 21.2 | 0.06 | 4.19 |
| Ex. 246 | 9.0 | 20.0 | 0.16 | 4.11 |
| Ex. 247 | 9.3 | 19.7 | 0.16 | 4.11 |

TABLE 21

| | Pulverized coal | | | Transportability improver | | | | Fluidity | | | | |
|---|---|---|---|---|---|---|---|---|---|---|---|---|
| | raw coal | | 106 μm or | | | | water concn. at pulverization | angle of | | | | |
| | kind | HGI | below (%) | compd. | concn. (%) | timing of addition | (%) | respose | compressibility | spatula angle | fluidity index | increase |
| Ex. 248 | coal e | 96 | 95 | $NaHPHO_3$ | 0.3 | before pulverization | 5.0 | 17 | 12 | 17 | 46 | 12 |
| Ex. 249 | coal e | 96 | 95 | $NaHSO_4$ | 0.3 | before pulverization | 5.0 | 17 | 12 | 17 | 46 | 12 |
| Ex. 250 | coal e | 96 | 95 | $NaPH_2O_2$ | 0.3 | before pulverization | 5.0 | 17 | 12 | 17 | 46 | 12 |
| Ex. 251 | coal e | 96 | 95 | $Na_2S_2O_4$ | 0.3 | before pulverization | 5.0 | 17 | 12 | 17 | 46 | 12 |
| Ex. 252 | coal e | 96 | 95 | $Na_2S_3O_6$ | 0.3 | before pulverization | 5.0 | 17 | 12 | 17 | 46 | 12 |
| Ex. 253 | coal e | 96 | 95 | $Na_2S_4O_6$ | 0.3 | before pulverization | 5.0 | 17 | 12 | 17 | 46 | 12 |
| Ex. 254 | coal e | 96 | 95 | $Na_2S_5O_6$ | 0.3 | before pulverization | 5.0 | 17 | 12 | 17 | 46 | 12 |
| Ex. 255 | coal e | 96 | 95 | $Na_2SiF_6$ | 0.3 | before pulverization | 5.0 | 17 | 12 | 17 | 46 | 12 |
| Ex. 256 | coal e | 96 | 95 | $Na_2SO_4$ | 0.3 | before pulverization | 5.0 | 17 | 12 | 17 | 46 | 12 |
| Ex. 257 | coal e | 96 | 95 | $Pb(NO_3)_2$ | 0.3 | before pulverization | 5.0 | 17 | 12 | 17 | 46 | 12 |
| Ex. 258 | coal e | 96 | 95 | $PbSiF_6$ | 0.3 | before pulverization | 5.0 | 17 | 12 | 17 | 46 | 12 |
| Ex. 259 | coal e | 96 | 95 | $Pb(ClO_3)_2$ | 0.3 | before pulverization | 5.0 | 17 | 12 | 17 | 46 | 12 |
| Ex. 260 | coal e | 96 | 95 | $Pb(ClO_4)_2$ | 0.3 | before pulverization | 5.0 | 17 | 12 | 17 | 46 | 12 |
| Ex. 261 | coal e | 96 | 95 | $Pb_3(Co(CN_6)_2$ | 0.3 | before pulverization | 5.0 | 17 | 12 | 17 | 46 | 12 |
| Ex. 262 | coal e | 96 | 95 | $ZnBr_2$ | 0.3 | before pulverization | 5.0 | 17 | 12 | 17 | 46 | 12 |
| Ex. 263 | coal e | 96 | 95 | $ZnCl_2$ | 0.3 | before pulverization | 5.0 | 17 | 12 | 17 | 46 | 12 |

| | Pressure drop ($mmH_2O/m$) | | Qty. of triboelectrifn. (μc/g) | |
|---|---|---|---|---|
| | pressure drop | decrease | qty. of triboelectrifn. | decrease |
| Ex. 248 | 9.2 | 19.8 | 0.19 | 4.08 |
| Ex. 249 | 9.2 | 19.8 | 0.19 | 4.08 |
| Ex. 250 | 9.2 | 19.8 | 0.16 | 4.11 |
| Ex. 251 | 9.2 | 19.8 | 0.18 | 4.09 |
| Ex. 252 | 8.8 | 20.2 | 0.16 | 4.11 |
| Ex. 253 | 8.9 | 20.1 | 0.16 | 4.11 |
| Ex. 254 | 8.9 | 20.1 | 0.15 | 4.12 |
| Ex. 255 | 9.0 | 20.0 | 0.18 | 4.09 |
| Ex. 256 | 7.5 | 21.5 | 0.08 | 4.19 |
| Ex. 257 | 9.1 | 19.9 | 0.16 | 4.11 |
| Ex. 258 | 8.9 | 20.1 | 0.19 | 4.08 |
| Ex. 259 | 9.1 | 19.9 | 0.18 | 4.09 |
| Ex. 260 | 8.8 | 20.2 | 0.06 | 4.11 |

TABLE 21-continued

| | | | | |
|---|---|---|---|---|
| Ex. 261 | 8.9 | 20.1 | 0.16 | 4.10 |
| Ex. 262 | 8.9 | 20.1 | 0.16 | 4.11 |
| Ex. 263 | 9.2 | 19.8 | 0.19 | 4.11 |

TABLE 22

| | Pulverized coal | | | Transportability improver | | | | | Fluidity | | | |
|---|---|---|---|---|---|---|---|---|---|---|---|---|
| | raw coal | | 106 μm or | | | | water concn. at | angle | | | | |
| | kind | HGI | below (%) | compd. | concn. (%) | timing of addition | pulverization (%) | of respose | compressibility | spatula angle | fluidity index | increase |
| Ex. 264 | coal e | 96 | 95 | $Zn(ClO_3)_2$ | 0.3 | before pulverization | 5.0 | 17 | 12 | 17 | 46 | 12 |
| Ex. 265 | coal e | 96 | 95 | $Zn(ClO_4)_2$ | 0.3 | before pulverization | 5.0 | 17 | 12 | 17 | 46 | 12 |
| Ex. 266 | coal e | 96 | 95 | $ZnI_2$ | 0.3 | before pulverization | 5.0 | 17 | 12 | 17 | 46 | 12 |
| Ex. 267 | coal e | 96 | 95 | $Zn(NO_3)_2$ | 0.3 | before pulverization | 5.0 | 17 | 12 | 17 | 46 | 12 |
| Ex. 268 | coal e | 96 | 95 | $ZnSO_4$ | 0.3 | before pulverization | 5.0 | 17 | 12 | 17 | 46 | 12 |
| Ex. 269 | coal e | 96 | 95 | $ZnSiF_6$ | 0.3 | before pulverization | 5.0 | 17 | 12 | 17 | 46 | 12 |
| Ex. 270 | coal e | 96 | 95 | $ZnSO_3$ | 0.3 | before pulverization | 5.0 | 17 | 12 | 17 | 46 | 12 |
| Ex. 271 | coal e | 96 | 95 | $HNO_3$ | 0.3 | before pulverization | 5.0 | 18 | 13 | 18 | 49 | 15 |
| Ex. 272 | coal e | 96 | 95 | $HNO_2$ | 0.3 | before pulverization | 5.0 | 17 | 12 | 17 | 46 | 12 |
| Ex. 273 | coal e | 96 | 95 | $H_2N_2O_2$ | 0.3 | before pulverization | 5.0 | 17 | 12 | 17 | 46 | 12 |
| Ex. 274 | coal e | 96 | 95 | $H_2CrO_4$ | 0.3 | before pulverization | 5.0 | 17 | 12 | 17 | 46 | 12 |
| Ex. 275 | coal e | 96 | 95 | $H_2Cr_2O_7$ | 0.3 | before pulverization | 5.0 | 17 | 12 | 17 | 46 | 12 |
| Ex. 276 | coal e | 96 | 95 | $H_2Cr_3O_{10}$ | 0.3 | before pulverization | 5.0 | 17 | 12 | 17 | 46 | 12 |
| Ex. 277 | coal e | 96 | 95 | $H_2Cr_4O_{13}$ | 0.3 | before pulverization | 5.0 | 17 | 12 | 17 | 46 | 12 |
| Ex. 278 | coal e | 96 | 95 | $H_2SO_4$ | 0.3 | before pulverization | 5.0 | 18 | 13 | 18 | 49 | 15 |
| Ex. 279 | coal e | 96 | 95 | $H_2SO_7$ | 0.3 | before pulverization | 5.0 | 17 | 12 | 17 | 46 | 12 |

| | Pressure drop ($mmH_2O/m$) | | Qty. of triboelectrifn. (μc/g) | |
|---|---|---|---|---|
| | pressure drop | decrease | qty. of triboelectrifn. | decrease |
| Ex. 264 | 8.8 | 20.2 | 0.19 | 4.11 |
| Ex. 265 | 9.2 | 19.8 | 0.16 | 4.09 |
| Ex. 266 | 9.1 | 19.9 | 0.18 | 4.12 |
| Ex. 267 | 8.8 | 20.2 | 0.16 | 4.09 |
| Ex. 268 | 9.1 | 19.9 | 0.16 | 4.10 |
| Ex. 269 | 9.0 | 20.0 | 0.15 | 4.11 |
| Ex. 270 | 8.9 | 20.1 | 0.18 | 4.11 |
| Ex. 271 | 7.8 | 21.2 | 0.15 | 4.19 |
| Ex. 272 | 8.7 | 20.3 | 0.16 | 4.09 |
| Ex. 273 | 8.8 | 20.2 | 0.19 | 4.09 |
| Ex. 274 | 9.2 | 19.8 | 0.19 | 4.08 |
| Ex. 275 | 8.8 | 20.2 | 0.18 | 4.09 |
| Ex. 276 | 9.2 | 19.8 | 0.19 | 4.08 |
| Ex. 277 | 9.1 | 19.9 | 0.17 | 4.10 |
| Ex. 278 | 7.8 | 21.2 | 0.08 | 4.19 |
| Ex. 279 | 9.2 | 19.8 | 0.16 | 4.11 |

TABLE 23

| | Pulverized coal | | | Transportability improver | | | | Fluidity | | | | |
|---|---|---|---|---|---|---|---|---|---|---|---|---|
| | raw coal | | 106 μm or | | | | water concn. at | angle | | | | |
| | kind | HGI | below (%) | compd. | concn. (%) | timing of addition | pulverization (%) | of respose | compressibility | spatula angle | fluidity index | increase |
| Ex. 280 | coal e | 96 | 95 | $H_2S_2O_8$ | 0.3 | before pulverization | 5.0 | 17 | 12 | 17 | 46 | 12 |
| Ex. 281 | coal e | 96 | 95 | $H_2SO_5$ | 0.3 | before pulverization | 5.0 | 17 | 12 | 17 | 46 | 12 |
| Ex. 282 | coal e | 96 | 95 | $H_2S_2O_3$ | 0.3 | before pulverization | 5.0 | 17 | 12 | 17 | 46 | 12 |
| Ex. 283 | coal e | 96 | 95 | $H_2S_2O_2$ | 0.3 | before pulverization | 5.0 | 17 | 12 | 17 | 46 | 12 |
| Ex. 284 | coal e | 96 | 95 | $H_3S_3O_6$ | 0.3 | before pulverization | 5.0 | 17 | 12 | 17 | 46 | 12 |
| Ex. 285 | coal e | 96 | 95 | $H_3S_4O_6$ | 0.3 | before pulverization | 5.0 | 17 | 12 | 17 | 46 | 12 |
| Ex. 286 | coal e | 96 | 95 | $H_3S_5O_6$ | 0.3 | before pulverization | 5.0 | 17 | 12 | 17 | 46 | 12 |
| Ex. 287 | coal e | 96 | 95 | $H_3S_6O_6$ | 0.3 | before pulverization | 5.0 | 17 | 12 | 17 | 46 | 12 |
| Ex. 288 | coal e | 96 | 95 | $H_2S_2O_6$ | 0.3 | before pulverization | 5.0 | 17 | 12 | 17 | 46 | 12 |
| Ex. 289 | coal e | 96 | 95 | $H_2SO_3$ | 0.3 | before pulverization | 5.0 | 17 | 12 | 17 | 46 | 12 |
| Ex. 290 | coal e | 96 | 95 | $H_2S_2O_5$ | 0.3 | before pulverization | 5.0 | 17 | 12 | 17 | 46 | 12 |
| Ex. 291 | coal e | 96 | 95 | $H_2S_2O_4$ | 0.3 | before pulverization | 5.0 | 17 | 12 | 17 | 46 | 12 |
| Ex. 292 | coal e | 96 | 95 | $H_2SO_2$ | 0.3 | before pulverization | 5.0 | 17 | 12 | 17 | 46 | 12 |
| Ex. 293 | coal e | 96 | 95 | HClO | 0.3 | before pulverization | 5.0 | 17 | 12 | 17 | 46 | 12 |
| Ex. 294 | coal e | 96 | 95 | $HClO_3$ | 0.3 | before pulverization | 5.0 | 17 | 12 | 17 | 46 | 12 |
| Ex. 295 | coal e | 96 | 95 | $HClO_3$ | 0.3 | before pulverization | 5.0 | 17 | 12 | 17 | 46 | 12 |

| | Pressure drop ($mmH_2O/m$) | | Qty. of triboelectrifn. (μc/g) | |
|---|---|---|---|---|
| | pressure drop | decrease | qty. of triboelectrifn. | decrease |
| Ex. 280 | 9.0 | 20.0 | 0.16 | 4.11 |
| Ex. 281 | 8.9 | 20.1 | 0.15 | 4.12 |
| Ex. 282 | 8.9 | 20.1 | 0.18 | 4.09 |
| Ex. 283 | 8.9 | 20.1 | 0.18 | 4.09 |
| Ex. 284 | 9.1 | 19.9 | 0.16 | 4.11 |
| Ex. 285 | 9.1 | 19.9 | 0.16 | 4.11 |
| Ex. 286 | 9.2 | 19.8 | 0.17 | 4.10 |
| Ex. 287 | 9.0 | 20.0 | 0.17 | 4.10 |
| Ex. 288 | 8.8 | 20.2 | 0.16 | 4.11 |
| Ex. 289 | 9.2 | 19.8 | 0.16 | 4.11 |
| Ex. 290 | 8.7 | 20.3 | 0.19 | 4.08 |
| Ex. 291 | 9.2 | 19.8 | 0.19 | 4.08 |
| Ex. 292 | 9.0 | 20.0 | 0.18 | 4.09 |
| Ex. 293 | 8.9 | 20.1 | 0.17 | 4.10 |
| Ex. 294 | 9.1 | 19.9 | 0.17 | 4.10 |
| Ex. 295 | 9.1 | 19.9 | 0.17 | 4.10 |

TABLE 24

| | Pulverized coal | | | Transportability improver | | | | Fluidity | | | | |
|---|---|---|---|---|---|---|---|---|---|---|---|---|
| | raw coal | | 106 μm or | | | | water concn. at | angle | | | | |
| | kind | HGI | below (%) | compd. | concn. (%) | timing of addition | pulverization (%) | of respose | compressibility | spatula angle | fluidity index | increase |
| Ex. 296 | coal e | 96 | 95 | HBrO | 0.3 | before pulverization | 5.0 | 17 | 12 | 17 | 46 | 12 |
| Ex. 297 | coal e | 96 | 95 | $HBrO_3$ | 0.3 | before pulverization | 5.0 | 17 | 12 | 17 | 46 | 12 |
| Ex. 298 | coal e | 96 | 95 | HIO | 0.3 | before pulverization | 5.0 | 17 | 12 | 17 | 46 | 12 |
| Ex. 299 | coal e | 96 | 95 | $HIO_3$ | 0.3 | before pulverization | 5.0 | 17 | 12 | 17 | 46 | 12 |
| Ex. 300 | coal e | 96 | 95 | $H_5IO_6$ | 0.3 | before pulverization | 5.0 | 17 | 12 | 17 | 46 | 12 |
| Ex. 301 | coal e | 96 | 95 | $H_2CO_3$ | 0.3 | before pulverization | 5.0 | 18 | 13 | 18 | 49 | 15 |
| Ex. 302 | coal e | 96 | 95 | $H_3PO_4$ | 0.3 | before pulverization | 5.0 | 17 | 12 | 17 | 46 | 12 |
| Ex. 303 | coal e | 96 | 95 | $H_4P_2O_6$ | 0.3 | before pulverization | 5.0 | 17 | 12 | 17 | 46 | 12 |
| Ex. 304 | coal e | 96 | 95 | $H_4P_2O_7$ | 0.3 | before pulverization | 5.0 | 17 | 12 | 17 | 46 | 12 |
| Ex. 305 | coal e | 96 | 95 | $H_2P_2O_6$ | 0.3 | before pulverization | 5.0 | 17 | 12 | 17 | 46 | 12 |
| Ex. 306 | coal e | 96 | 95 | $H_4P_4O_{12}$ | 0.3 | before pulverization | 5.0 | 17 | 12 | 17 | 46 | 12 |
| Ex. 307 | coal e | 96 | 95 | $H_4P_2O_5$ | 0.3 | before pulverization | 5.0 | 17 | 12 | 17 | 46 | 12 |
| Ex. 308 | coal e | 96 | 95 | $H_4P_2O_8$ | 0.3 | before pulverization | 5.0 | 17 | 12 | 17 | 46 | 12 |
| Ex. 309 | coal e | 96 | 95 | HF | 0.3 | before pulverization | 5.0 | 17 | 12 | 17 | 46 | 12 |
| Ex. 310 | coal e | 96 | 95 | HCl | 0.3 | before pulverization | 5.0 | 18 | 13 | 18 | 49 | 15 |
| Ex. 311 | coal e | 96 | 95 | HBr | 0.3 | before pulverization | 5.0 | 17 | 12 | 17 | 46 | 12 |

| | Pressure drop ($mmH_2O/m$) | | Qty. of triboelectrifn. (μc/g) | |
|---|---|---|---|---|
| | pressure drop | decrease | qty. of triboelectrifn. | decrease |
| Ex. 296 | 8.8 | 20.2 | 0.19 | 4.08 |
| Ex. 297 | 8.7 | 20.3 | 0.18 | 4.09 |
| Ex. 298 | 9.0 | 20.0 | 0.16 | 4.11 |
| Ex. 299 | 9.0 | 20.0 | 0.18 | 4.09 |
| Ex. 300 | 9.0 | 20.0 | 0.18 | 4.09 |
| Ex. 301 | 7.8 | 21.2 | 0.08 | 4.19 |
| Ex. 302 | 9.0 | 20.0 | 0.18 | 4.09 |
| Ex. 303 | 9.0 | 20.0 | 0.18 | 4.09 |
| Ex. 304 | 9.0 | 20.0 | 0.18 | 4.09 |
| Ex. 305 | 9.0 | 20.0 | 0.18 | 4.09 |
| Ex. 306 | 9.0 | 20.0 | 0.18 | 4.09 |
| Ex. 307 | 9.0 | 20.0 | 0.18 | 4.09 |
| Ex. 308 | 9.0 | 20.0 | 0.18 | 4.09 |
| Ex. 309 | 9.0 | 20.0 | 0.18 | 4.09 |
| Ex. 310 | 7.8 | 21.2 | 0.08 | 4.19 |
| Ex. 311 | 9.0 | 20.0 | 0.18 | 4.09 |

TABLE 25

| | Pulverized coal | | | Transportability improver | | | | Fluidity | | | | |
|---|---|---|---|---|---|---|---|---|---|---|---|---|
| | raw coal | | 106 μm or | | | | water | angle | | | | |
| | kind | HGI | below (%) | compd. | concn. (%) | timing of addition | concn. at pulverization (%) | of respose | compressibility | spatula angle | fluidity index | increase |
| Ex. 312 | coal e | 96 | 95 | HI | 0.3 | before pulverization | 5.0 | 17 | 12 | 17 | 46 | 12 |
| Ex. 313 | coal e | 96 | 95 | $H_2CrO_4$ | 0.3 | before pulverization | 5.0 | 17 | 12 | 17 | 46 | 12 |
| Ex. 314 | coal e | 96 | 95 | $H_2Cr_2O_7$ | 0.3 | before pulverization | 5.0 | 17 | 12 | 17 | 46 | 12 |
| Ex. 315 | coal e | 96 | 95 | $H_2Cr_3O_{10}$ | 0.3 | before pulverization | 5.0 | 17 | 12 | 17 | 46 | 12 |
| Ex. 316 | coal e | 96 | 95 | $H_2Cr_4O_{13}$ | 0.3 | before pulverization | 5.0 | 17 | 12 | 17 | 46 | 12 |
| Ex. 317 | coal e | 96 | 95 | $H_2B_2O_5$ | 0.3 | before pulverization | 5.0 | 17 | 12 | 17 | 46 | 12 |
| Ex. 318 | coal e | 96 | 95 | $H_2B_4O_7$ | 0.3 | before pulverization | 5.0 | 17 | 12 | 17 | 46 | 12 |
| Ex. 319 | coal e | 96 | 95 | $H_2B_6O_{10}$ | 0.3 | before pulverization | 5.0 | 17 | 12 | 17 | 46 | 12 |
| Ex. 320 | coal e | 96 | 95 | $HBO_2$ | 0.3 | before pulverization | 5.0 | 17 | 12 | 17 | 46 | 12 |
| Ex. 321 | coal e | 96 | 95 | $HBO_3$ | 0.3 | before pulverization | 5.0 | 17 | 12 | 17 | 46 | 12 |
| Ex. 322 | coal e | 96 | 95 | HBrO | 0.3 | before pulverization | 5.0 | 17 | 12 | 17 | 46 | 12 |
| Ex. 323 | coal e | 96 | 95 | $HBrO_3$ | 0.3 | before pulverization | 5.0 | 17 | 12 | 17 | 46 | 12 |

| | Pressure drop ($mmH_2O/m$) | | Qty. of triboelectrifn. (μc/g) | |
|---|---|---|---|---|
| | pressure drop | decrease | qty. of triboelectrifn. | decrease |
| Ex. 312 | 9.0 | 20.0 | 0.18 | 4.09 |
| Ex. 313 | 9.0 | 20.0 | 0.18 | 4.09 |
| Ex. 314 | 9.0 | 20.0 | 0.18 | 4.09 |
| Ex. 315 | 9.0 | 20.0 | 0.18 | 4.09 |
| Ex. 316 | 9.0 | 20.0 | 0.18 | 4.09 |
| Ex. 317 | 9.0 | 20.0 | 0.18 | 4.09 |
| Ex. 318 | 9.0 | 20.0 | 0.18 | 4.09 |
| Ex. 319 | 9.0 | 20.0 | 0.18 | 4.09 |
| Ex. 320 | 9.0 | 20.0 | 0.18 | 4.09 |
| Ex. 321 | 9.0 | 20.0 | 0.18 | 4.09 |
| Ex. 322 | 9.0 | 20.0 | 0.18 | 4.09 |
| Ex. 323 | 9.0 | 20.0 | 0.18 | 4.09 |

The term "106 μm or below (%)" used in Tables 1 to 25 refers to the content (% by weight) of particles 106 μm or below in diameter in pulverized coal.

In the above Examples and Comparative Examples, all transportability improvers were used in the form of aqueous solution.

The term "decrease" used in Tables 2 to 25 refers to one determined by the comparison with the value observed in the corresponding Comparative Example wherein no transportability improver is added.

Figure 9:
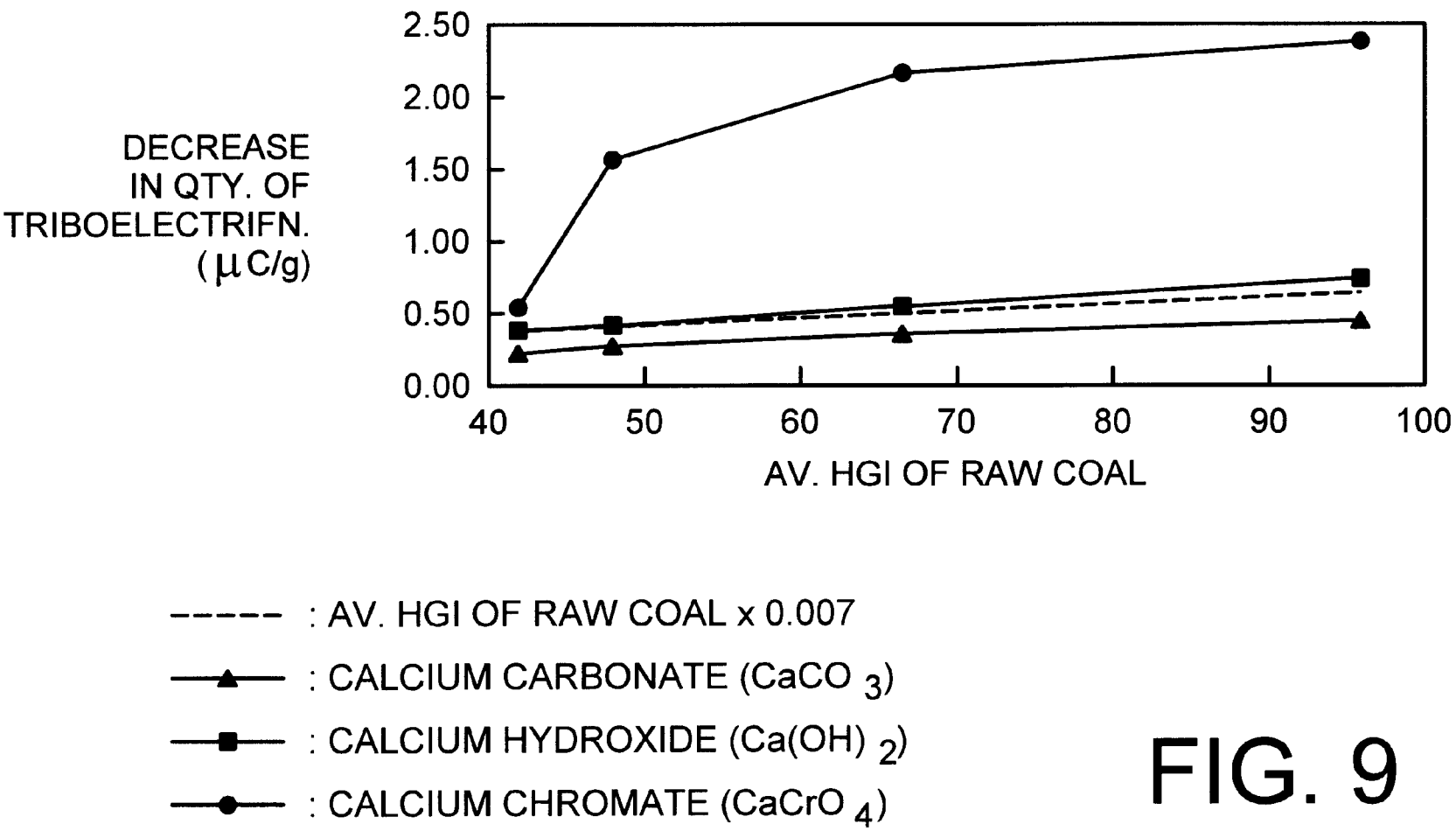
FIG. 9 is a graph showing the relationships between the average HGI of raw coal and quantity of triboelectrification of pulverized coal as observed in the cases wherein several transportability improvers are used.

A graph showing the relationships between average HGI of raw coal and decrease in the quantity of triboelectrification in the cases wherein several transportability improvers were used was made on the basis of the results of Comparative Examples 10 to 13 and Examples 1 to 8, and is shown in FIG. 9.

Example 324

An example of the application to pulverized coal injection equipment for blast furnace will now be described.

Conditions:

injection rate of pulverized coal: 40 t/hr transportability improver: ammonium sulfate amount: 0 or 0.3 wt. % pulverized coal: content of particles 106 μm or below in diameter: 95% water content: 1.5% av. HGI of raw coal: 45, 55, 70

Figure 3:
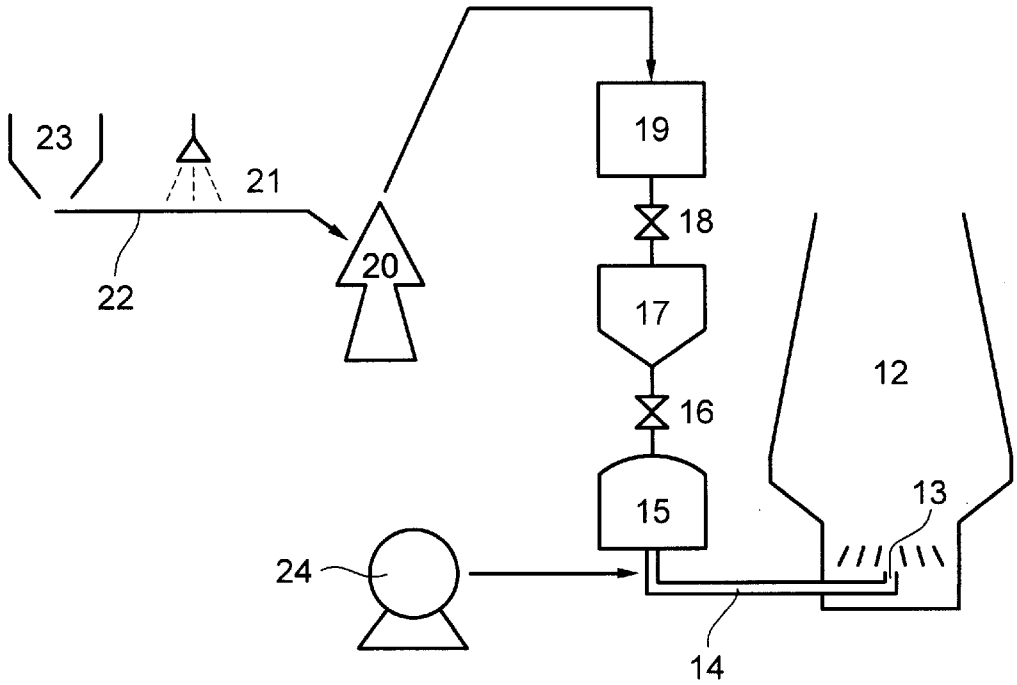
FIG. 3 is a schematic view of the actual pulverized coal injection equipment for blast furnace used in Example 324.

A schematic view of the pulverized coal injection equipment for blast furnace used in this Example is shown in FIG. 3, wherein numeral 12 refers to a blast furnace, 13 refers to an injection port, 14 refers to injection piping, 15 refers to a distribution tank, 16 refers to a valve, 17 refers to an equalization tank, 18 refers to a valve, 19 refers to a storage tank for pulverized coal, 20 refers to a coal pulverizer, 21 refers to a nozzle for spraying additives, 22 refers to a belt conveyor for transferring coal, 23 refers to a hopper for receiving coal, and 24 refers to an air or nitrogen compressor.

Coal was thrown into the hopper 23 and fed into the pulverizer 20 by the conveyor 22, while a transportability improver was sprayed on the coal through the nozzle 21 in the course of this step. The coal was pulverized into particles having the above diameter in the pulverizer 20 and transferred to the storage tank 19. First, the valve 18 was opened in a state wherein the internal pressure of the equalization tank 17 was equal to the atmospheric pressure, and a predetermined amount of the pulverized coal was fed from the storage tank 19 to the equalization tank 17. Then, the internal presssure of the equalization tank 17 was enhanced to that of the distribution tank 15. The valve 16 was opened in a state wherein the internal pressure of the tank 15 was equal to that of the tank 17, whereby the pulverized coal was made fall by gravity. The pulverized coal was pneumatically transported from the distribution tank 15 to the injection port 13 through the injection piping 14 by the air fed by the compressor 24, and injected into the blast furnace 12 through the injection port 13.

<Effects of the addition of the transportability improver>

The transport of pulverized coal was conducted under the above conditions with the addition of the transportability improver or without it to determine the difference in transfer time (the time took for transferring pulverized coal from the tank 17 to the tank 15) between the two cases and that in pressure drop in the injection piping 14 (i.e., the differential pressure between the tank 15 and the blast furnace 12) in the two cases. The results are given in FIGS. 4, 5 and 6.

Figure 4:
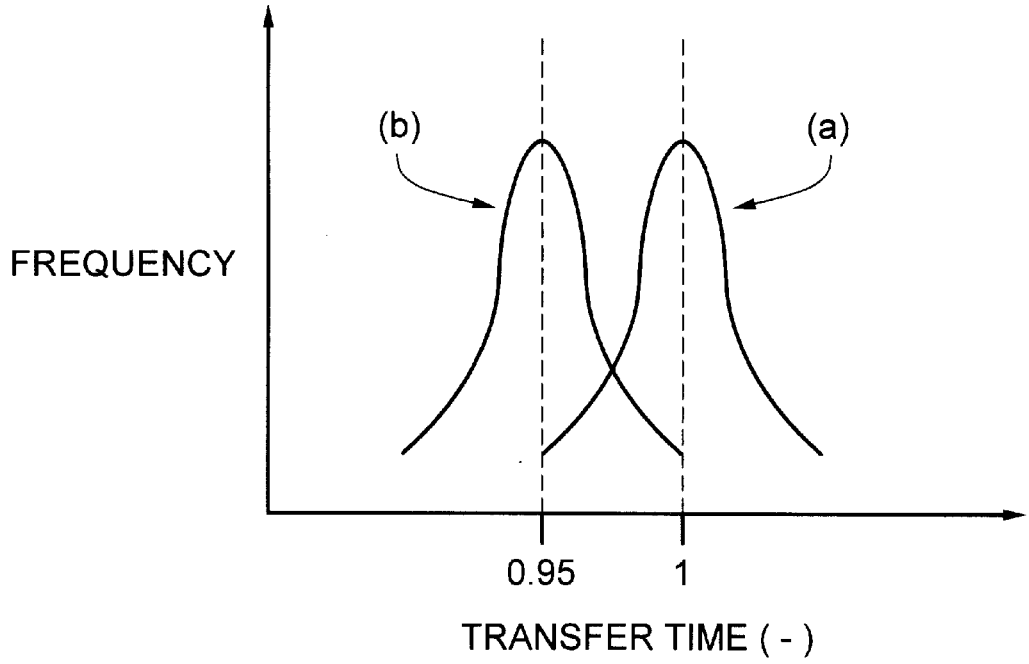
FIG. 4 is a chart showing the transfer times as observed in Example 324.
Figure 5:
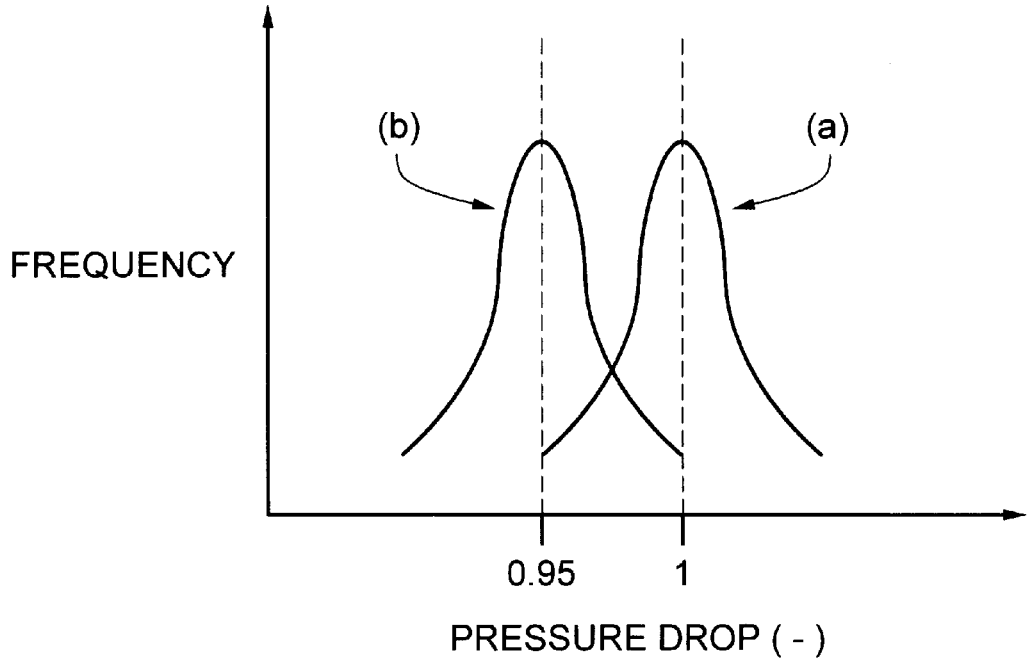
FIG. 5 is a chart showing the pressure drops in piping as observed in Example 324.
Figure 6:
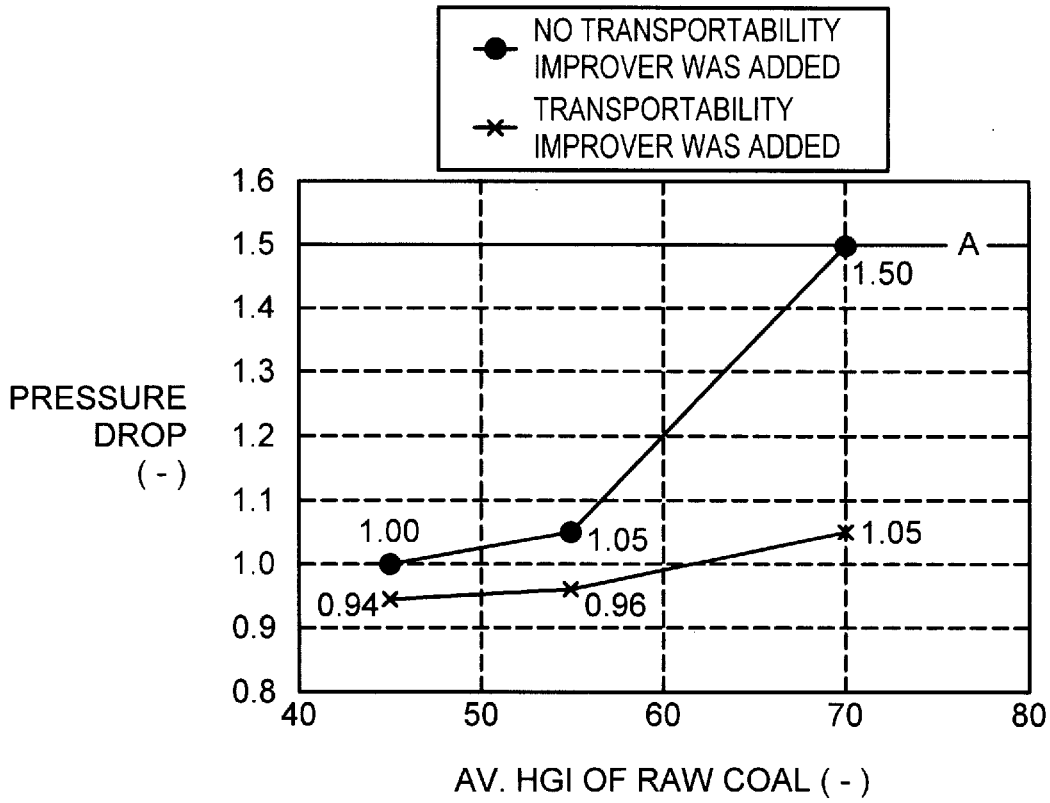
FIG. 6 is a graph showing the pressure drops in piping as observed in Example 324.

In FIGS. 4 and 5, (a) refers to the case wherein no transportability improver was added, and (b) the case wherein the transportability improver was added. In FIG. 6, "A" refers to the upper limit of equipment.

When raw coal having an average HGI of 45 was used, as shown in FIGS. 4 and 5, the pressure drop in piping and the transfer time were lowered, which makes it possible without any change in the equipment to inject an enhanced quantity of pulverized coal. Further, a satisfactory injection power can be attained by the use of equipment simpler than that of the prior art FIGS. 4 and 5 show relative evaluation wherein the value obtained without any transportability improver is taken as 1.

Further, FIG. 6 shows the pressure drops in piping as observed when raw coals having average HGI of 45, 55 and 70 respectively were used. Even when a high-HGI coal was used, the pressure drop in pipe could be lowered to the upper limit of equipment or below by the addition of the transportability improver, which enables the use of various kinds of coals including inexpensive ones in pulverized-coal injection. FIG. 6 shows relative evaluation, wherein the value obtained by using raw coal having an average HGI of 45 without any transportability improver is taken as 1.

Example 325

An example of the application to a pulverized coal firing boiler will now be described.

transportability improver: ammonium sulfate
- amount: 0 or 0.3 wt. %
- pulverized coal: content of particles 106 μm or below in diameter: 95%
- water content: 1.5%
- av. HGI of raw coal: 45, 55, 65, 75

Figure 7:
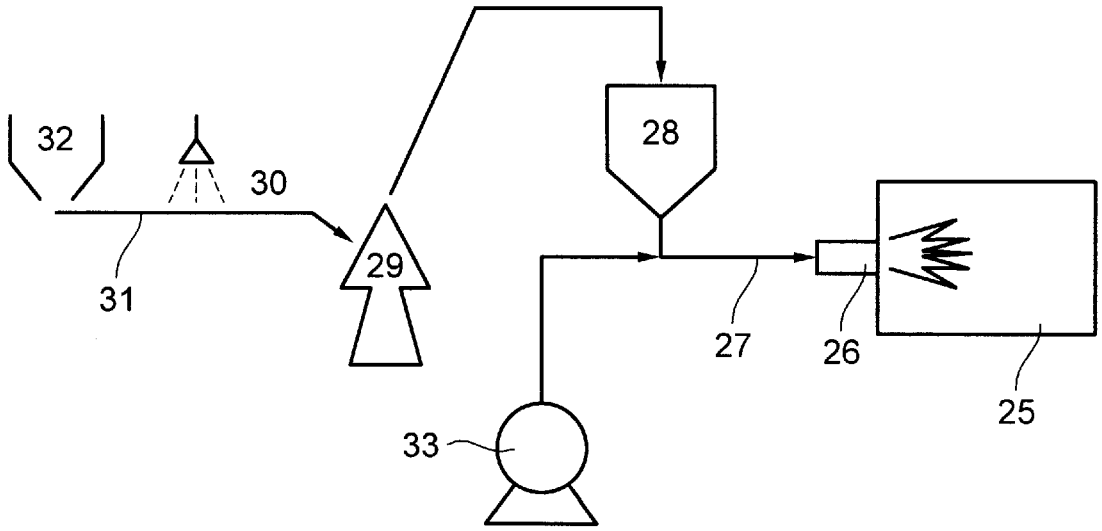
FIG. 7 is a schematic view of the pulverized coal firing boiler used in Example 325.

A schematic view of the pulverized coal firing boiler used in this Example is shown in FIG. 7, wherein numeral 25 refers to a combustion chamber, 26 refers to a burner, 27 refers to injection piping, 28 refers to a storage tank for pulverized coal, 29 refers to a coal pulverizer, 30 refers to a nozzle for spraying additives, 31 refers to a conveyor for transferring coal, 32 refers to a hopper for receiving coal, and 33 refers to an air or nitrogen compressor.

Coal was thrown into the hopper 33 and fed into the pulverizer 29 by the conveyor 31, while a transportability improver was sprayed on the coal through the nozzle 30 in the course of this step. The coal was pulverized into particles having the above diameter in the pulverizer 29 and transferred to the storage tank 28. Then, the pulverized coal was pneumatically transported by an air fed from the compressor 33, fed into the burner 26, and fired therein.

<Effects of the addition of the transportability improver>

Figure 8:
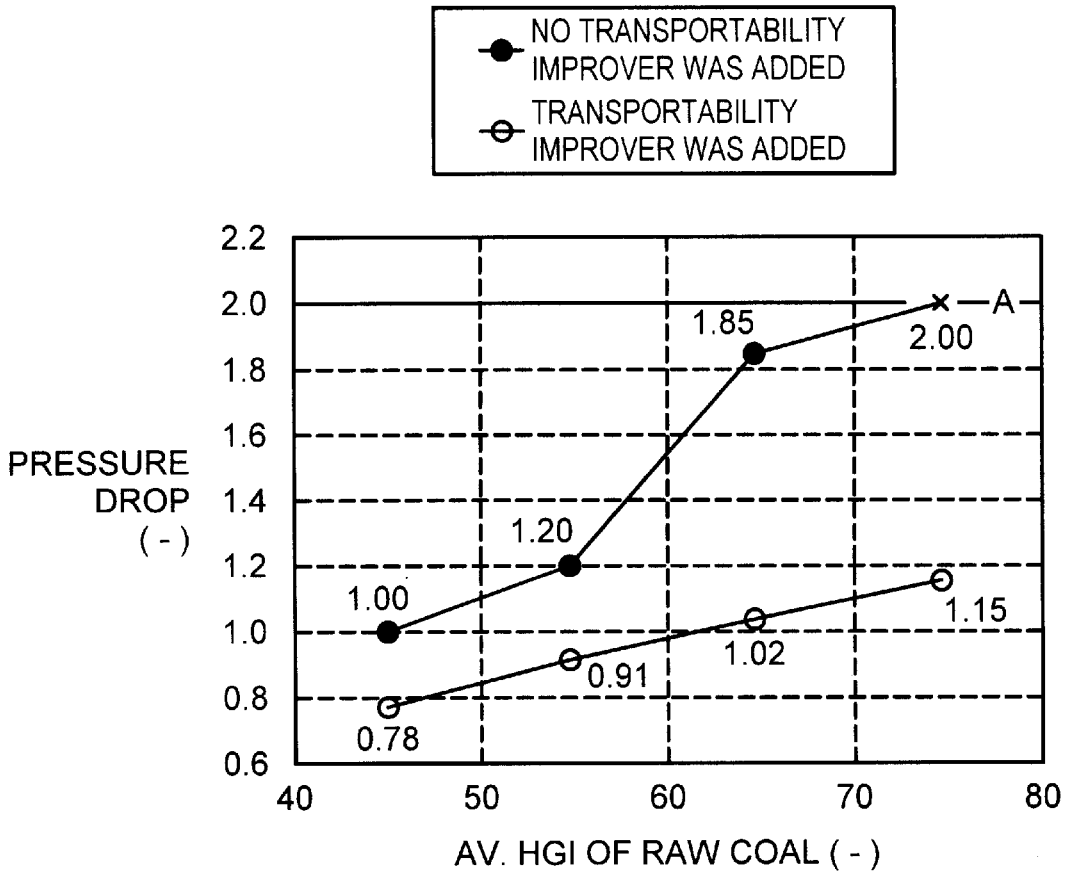
FIG. 8 is a graph showing the pressure drops in piping as observed in Example 325.

The transport of pulverized coal was conducted under the above conditions with the addition of the transportability improver or without it to determine the difference between the two cases in pressure drop in the injection piping 27 (i.e., differential pressure between the tank 28 and the burner 26). The results are given in FIG. 8, wherein "A" refers to the upper limit of equipment and "X" refers to clogging in piping. Further, FIG. 8 shows relative evaluation wherein the value obtained by using raw coal having an average HGI of 45 without any transportability improver is taken as 1.

Even when any of the above raw coals (having average HGI of 45, 55, 65 and 75 respectively) was used, the pressure drop in piping could be lowered to the upper limit of equipment or below by the addition of the transportability improver. That is, even when a high-HGI coal was used, the pressure drop in piping could be lowered to the upper limit or below, which enables the use of more kinds of coals in pulverized coal injection.

What is claimed is:

1. A method for improving pneumatic transportability of pulverized coal, comprising:

applying a water-soluble inorganic salt to a pulverized coal, said pulverized coal is prepared by pulverizing the raw coal having an average HGI of 30 or above at a water concentration in coal ranging from 0.5 to 30% by weight and said pulverized coal contains in amount of 10% by weight or above, coal particles of 106 μm or below in diameter, wherein the treated pulverized coal is in a dry state at the injection port of a metallurgical furnace or a combustion furnace.

2. The method for improving pneumatic transportability of pulverized coal according to claim 1, wherein said pulverized coal is prepared from raw coal having an average HGI of 50 or above.

3. The method for improving pneumatic transportability of pulverized coal according to claim 1, wherein when said water-soluble inorganic salt is applied to said pulverized coal in an amount of 0.3% by weight based on the coal by dry basis, the quantity of triboelectrification of said pulverized coal is decreased by the average HGI of the feed coal×0.007 μC/g or above.

4. The method for improving pneumatic transportability of pulverized coal according to claim 1, wherein when said water-soluble inorganic salt is applied to said pulverized coal in an amount of 0.3% by weight based on the coal by dry basis, the quantity of triboelectrification of said pulverized coal is 2.8 μC/g or below.

5. The method for improving pneumatic transportability of pulverized coal according to claim 1, wherein the application of said water-soluble inorganic salt to said pulverized coal is conducted before the pulverization of the raw coal.

6. The method for improving pneumatic transportability of pulverized coal according to claim 1, wherein the application of said water-soluble inorganic salt to said pulverized coal is conducted during the pulverization of the raw coal.

7. A pulverized coal, comprising:

a water-soluble inorganic salt adhered to the surface of said pulverized coal, said pulverized coal is prepared by pulverizing feed coal having HGI of 30 or above at a water concentration in coal ranging from 0.5 to 30% by weight and said pulverized coal contains in amount of 10% by weight or above, coal particles of 106 μm or below in diameter, wherein said pulverized coal is in a dry state at the injection port of a metallurgical or combustion furnace.

8. The pulverized coal according to claim 7, wherein said pulverized coal is prepared by pulverizing feed coal having HGI of 50 or above.

9. The pulverized coal according to claim 7, wherein when said water-soluble inorganic salt is applied to said pulverized coal in an amount of 0.3% by weight based on the coal by dry basis, the quantity of triboelectrification of said pulverized coal is decreased by the average HGI of the feed coal×0.007 μC/g or above.

10. The pulverized coal according to claim 7, wherein when said water-soluble inorganic salt is applied to said pulverized coal in an amount of 0.3% by weight based on the coal by dry basis, the quantity of triboelectrification of said pulverized coal is 2.8 μC/g or below.

11. The pulverized coal according to claim 7, wherein said water-soluble inorganic salt is applied to said pulverized coal before the pulverization of the raw coal.

12. The pulverized coal according to claim 7, wherein said water-soluble inorganic salt is applied to said pulverized coal during the pulverization of the raw coal.

13. The pulverized coal according to claim 7, wherein said pulverized coal has 0.01 to 10% by weight based on the coal by dry basis of said water-soluble inorganic salt on its surface and the quantity of triboelectrification of said pulverized coal is decreased by the average HGI of the feed coal×0.007 μC/g or above.

14. The pulverized coal according to claim 13, wherein said pulverized coal has 0.01 to 10% by weight based on the coal by dry basis of said water-soluble inorganic salt on its surface and the quantity of triboelectrification of said pulverized coal is 2.8 μC/g or below.

15. The pulverized coal according to claim 7, wherein said water-soluble inorganic salt exhibits a solubility of 0.1 or above at 25° C.

16. A method for operating a metallurgical or combustion furnace, comprising:

preparing a pulverized coal having a water-soluble inorganic salt adhered to its surface by pulverizing raw coal having an average HGI of 30 or above at a water concentration in coal ranging from 0.5 to 30% by weight and said pulverized coal contains in amount of 10% by weight or above, coal particles of 106 μm or above in diameter and the treated pulverized coal is in a dry state at the injection port; and injecting said pulverized coal into the furnace through an injection port.

17. The method for operating a metallurgical or combustion furnace according to claim 16, wherein preparing a pulverized coal having a water-soluble inorganic salt adhered to the surface of said pulverized coal by pulverizing raw coal having an average HGI of 50 or above.

18. The method for operating a metallurgical or combustion furnace according to claim 16, wherein said pulverized coal has 0.01 to 10% by weight based on the coal by dry basis of said water-soluble inorganic salt on the surface of said pulverized coal.

19. The method for operating a metallurgical or combustion furnace according to claim 16, wherein said pulverized coal has 0.01 to 10% by weight based on the coal by dry basis of said water-soluble inorganic salt on its surface and the quantity of triboelectrification of said pulverized coal is decreased by the average HGI of the feed coal×0.007 μC/g or above.

20. The method for operating a metallurgical or combustion furnace according to claim 16, wherein said pulverized coal has 0.01 to 10% by weight based on the coal by dry basis of said water-soluble inorganic salt on its surface and the quantity of triboelectrification of said pulverized coal is 2.8 μC/g or below.

21. The method for operating a metallurgical or combustion furnace according to claim 16, wherein said water-soluble inorganic salt is applied to said pulverized coal before the pulverization of the raw coal.

22. The method for operating a metallurgical or combustion furnace according to claim 16, wherein said water-soluble inorganic salt is applied to said pulverized coal during the pulverization of the raw coal.

* * * * *